US006503695B1

(12) United States Patent
Miyazawa et al.

(10) Patent No.: US 6,503,695 B1
(45) Date of Patent: Jan. 7, 2003

(54) IMAGE FORMING METHOD

(75) Inventors: Kazuhiro Miyazawa, Hino (JP); Junji Ito, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/704,780

(22) Filed: Nov. 3, 2000

(30) Foreign Application Priority Data

Nov. 4, 1999 (JP) ..... 11-313495

(51) Int. Cl.[7] ..... G03C 7/30; G03C 7/26
(52) U.S. Cl. ..... 430/363; 430/503; 430/505
(58) Field of Search ..... 430/363, 503, 430/505

(56) References Cited

U.S. PATENT DOCUMENTS 5,260,176 A * 11/1993 Otani et al. ..... 430/363
5,783,373 A * 7/1998 Mydlarz et al. ..... 430/363
6,043,020 A * 3/2000 Ohtani ..... 430/363
6,245,496 B1 * 6/2001 Yokozawa ..... 430/363
6,248,507 B1 * 6/2001 Budz et al. ..... 430/363

FOREIGN PATENT DOCUMENTS

| | | |
|---|---|---|
| EP | 0 844 528 A1 | 5/1998 |
| EP | 1 048 976 A2 | 11/2000 |
| JP | 5-19423 | 1/1993 |
| JP | 6-295033 | 10/1994 |
| JP | 10-20460 | 1/1998 |

OTHER PUBLICATIONS

European Search Report dated Jun. 24, 2002.

* cited by examiner

*Primary Examiner*—Richard L. Schilling

(57) ABSTRACT

A silver halide color photographic light-sensitive material is disclosed. The silver halide color photographic light-sensitive material is exposed by scanning with a light beam having a pixel size of r $\mu$m for a time of not more than $10^{-3}$ seconds per pixel, and developed wherein the difference of a hwb value in thus obtained image in each of the color-forming layers and the value of r is within the range of form 0 to 50, in which the hwb is the half band width in $\mu$m of a line reproducing the line having a width of one pixel.

4 Claims, No Drawings

IMAGE FORMING METHOD

FIELD OF THE INVENTION

This invention relates to a silver halide color photographic light-sensitive material and an image forming method using the light-sensitive material suitable for reproducing an image according to digital image information or a negative image formed on a negative film.

BACKGROUND OF THE INVENTION

Recently, a chance of handling an image in a form of digital data is rapidly increased depending on the rising of processing ability of computer or the progress of network technology. The image information digitized by a scanner can be easily processed or edited by a computer. Moreover, another data such as a character or an illustration can be easily added to the digitized image information. The material for making a hard copy according to the digitized image information includes, for example, a sublimation-type thermal transfer printing material, a thermal fusion transfer printing material, an ink-jet printing material, a static transfer printing material, a thermo-autochrome printing material and silver halide photographic material are usable. Among them, the silver halide color photographic material, hereinafter simply referred to a light-sensitive material, is frequently used for making a high quality hard copy since the light-sensitive material is excellent in the characteristics such as the high sensitivity, gradation and image storage ability, compared with the other printing materials.

The image information digitized by a scanner can be easily processed or edited by a computer. Moreover, another data such as a character or an illustration can be easily added to the digitized image information. Accordingly, a picture including a photographic image such as a portrait, scene and still life, hereinafter referred to a picture image, and a character image, particularly a fine and small black character image, is frequently handled. It is necessary, therefore, in the image output according to the digital data to simultaneously-satisfy two requirements of that the picture image is naturally reproduced and the character image is reproduced with no blur.

Furthermore, the resolving power of an image-input apparatus such as a digital still camera or a film scanner is considerably risen in recent some years. Depending on such the situation, rising of the resolving power of an output apparatus or the digital exposing apparatus is investigated for making a print using the high quality image data obtained by such the image-input apparatus.

A light beam scanning method has been known as one of methods generally used for digital exposing. In this instance a method exposing with overlapping the main scanning line, i.e., raster, at certain ratio is known in order to reduce generation of scanning noise line by the disclosure of Japanese Patent Publication Open to Public Inspection, hereinafter referred to JP O.P.I., No. 5-19423, JP O.P.I., No. 6-295033 etc. In this method, it is effective that the diameter of the light beam applied for exposure is generally reduced in order to improve high resolving power, and it enables to display fine line pattern particularly such as character image clearer more in detail. In such the case, the transportation pitch of the light beam in the direction of scanning, the main scanning direction, and that of the sub-scanning direction being at right angles with the main scanning direction are reduced when the overlapping ratio of the adjacent light beams or the beam multiplicity is constantly maintained, the time for exposing tends to be prolonged and productivity tends to deteriorate since transportation pith of scanning direction of beam (main scanning direction) and vertical scanning direction (sub scanning direction) must be reduced. On the other hand, when the light beam diameter is only reduced while the transportation pitch in the subscanning direction is maintained at constant, beam multiplicity is reduced and therefore a periodical scanning noise line tends to be formed in an area in which a constant density data are continued some degree in particular it is difficult to reproduce the image having many uniform density portion such as illustration with high quality. Consequently, the high image quality reproducing fine line image and image having uniform density are difficultly compatible and further maintaining the high productivity is difficult in the digital exposing apparatus, and an improvement on that is demanded.

As one of method to improving character image quality JP O.P.I., No. 10-20460 describes a method for rising the character image quality by using a silver halide color photographic light-sensitive material having a specific ratio of the point gamma value at a certain density obtained by an exposure time of 0.1 seconds to that obtained by an exposure time of $10^{-4}$ seconds. Though the method improves the character image quality in both of plane exposure and scanning exposure, the JP O.P.I. mentioned above does not describe improving the exposure line noise at the same density area which tends to generate when the subscanning rate is improved for high productivity that is transportation pitch is made large. U.S. Pat. No. 5,744,287 describes a method to improve the image sharpness at a high sensitivity area by adjusting the maximum gamma value and the fill-in $D_{max}$ formed by the digital exposure, however it does not describe improving the exposure line noise at the same density area which tends to generate when the subscanning rate is improved for high productivity that is transportation pitch is made large. By preparing the light sensitive material so as to have high fill-in $D_{max}$, though a preferable image having high clearance is obtained in a void image which has fine pattern with low density in a high density background, the reproduction is not always improved in an image with black characters which has a fine pattern with high density in low density background. The reason, which is not clarified in detail, is possibly assumed as follows. It is general to employ a method overlapping the light beams in certain ratio in order to reduce the scanning line noise at uniform density area in scanning exposure. Therefore, in fill-in $D_{max}$, which is obtained by the out-put result of void fine line of one or two pixels at the uniform density area, void fine line part is not exposed at all, but is assumed to be effected the blur of light beam of neighboring main scanning line. Further, it is known that light scattering phenomena within support, which is called piping, in the reflective support such as RC paper, and in this instance, the void fine line area is also assumed to be affected by blur of the light beam of exposure of main scanning line apart from several lines. Though usually only such weak light scarcely affects image formation, there may be a possibility that it affects image formation as known subsidiary exposing effect when the exposure is superposed. On the other hand, it is assumed that improvement of reproduction at void fine line area is not always reflected since exposure of neighboring main scanning line does not affect image in case that black fine lines in white background such as black characters are out put. Consequently further improvement is demanded because it is not insufficient to make compatible of reproduction of image with-fine lines area such as black characters and uniform density area by adjusting the fill-in $D_{max}$ to desirable value.

SUMMARY OF THE INVENTION

The object of the invention is to provide a silver halide color photographic light-sensitive material and a image forming method by which the reproducibility is risen and the scanning ununiformity of image is inhibited, a beautiful printed image can be obtained independently on the kind of digital exposing apparatus, and a beautiful printed image can be obtained in both cases of the exposure according to the digital image information and the exposure through a negative film.

The present invention and the embodiments of the invention are described below.

A silver halide color photographic light-Sensitive material comprising a support having thereon a yellow image-forming layer, a magenta image-forming layer and a cyan image-forming layer each containing light-sensitive silver halide, wherein the silver halide color photographic light-sensitive material when exposed by scanning with a light beam having a pixel size of r $\mu$m for a time of not more than $10^{-3}$ seconds per pixel provides after development the value of hwb−r) in thus obtained image in each of the color-forming layer is within the range of from 0 to 50, in which hwb is the half band width value in $\mu$m Of a line reproducing a line having a width of one pixel.

The silver halide color photographic light-sensitive material wherein the value of (hww−r) in thus obtained image in each of the color-forming layers is within the rage of from 15 to 65 $\mu$m, in which hww is the half band width value in $\mu$m Of a white line reproducing a white line having a width of one pixel.

The silver halide color photographic light-sensitive material wherein the value of (hwb−r) in thus obtained image in the yellow image-forming layer is smallest.

The silver halide color photographic light-sensitive material wherein the value of (hww−r) in thus obtained image in the yellow image-forming layer is largest.

The silver halide color photographic light-sensitive material wherein the ratio of the largest hwb value ($hwb_{max}$) to the smallest hwb value ($hwb_{min}$), $hwb_{max}/hwb_{min}$, among each of the color image-forming layers is within the range of from 1.0 to 1.1.

The silver halide color photographic light-sensitive material wherein the ratio of the largest hww value ($hww_{max}$) to the smallest hww value ($hww_{min}$) $hww_{max}/hww_{min}$, among each of the color image-forming layers is within the range of from 1.0 to 1.1.

The silver halide color photographic light-sensitive material wherein the ratio of the hwb value to a fwb value, hwb/fwb, of thus obtained image in each of the color-forming layers is within the range of from 0.3 to 0.4, in which fwb is a width value at the legs in $\mu$m Of a line reproducing the line having a width of one pixel.

The silver halide color photographic light-sensitive material wherein the ratio of the hww value to a fww value, hww/fww, of thus obtained image in each of the color-forming layers is within the range of from 0.3 to 0.4, in which the fww is a width value at the legs in $\mu$m Of a white line reproducing the line having a width of one pixel.

The silver halide color photographic light-sensitive material wherein the ratio of $\gamma a$ to $\gamma d$, $\gamma x/\gamma d$, is within the range of from 1.0 to 1.15, in which $\gamma x$ is a gradation of the image formed in each of the color image-forming layers by exposing by one shot exposure for a time of 0.5 seconds and developing; $\gamma d$ is a gradation of the image formed in each of the color image-forming layers by exposing by scanning with the light beam at less than $10^{-3}$ seconds per pixel and developing.

The silver halide color photographic light-sensitive material wherein the ratio of $\gamma x$ to $\gamma d$, $\gamma x/\gamma d$, is within the range of from 1.0 to 1.5, in which $\gamma x$ is a gradation of the image formed in each of the color image-forming layers by exposing by one shot exposure for a time of $10^{-6}$ seconds and developing; $\gamma d$ is a gradation of the image formed in each of the color image-forming layers by exposing by scanning with the light beam at less than $10^{-3}$ seconds per pixel and developing.

An image forming method of silver halide color photographic light-sensitive material comprising the steps of, exposing a silver halide color photo graphic light-sensitive material comprising a support having thereon an yellow image-forming layer, a magenta image-forming layer and a cyan image-forming layer each containing light-sensitive silver halide by scanning with a light beam having a pixel Size of r $\mu$m for a time of not more than $10^{-3}$ seconds per pixel, and developing the silver halide color photographic light-sensitive material, wherein the value of (hwb−r) is within the range of from 0 to 50, in which hwb is the half band width value in $\mu$m of a line reproducing a line having a width of one pixel.

The image forming method wherein the value of (hww−r) in thus obtained image in each of the color-forming layers is within the rage of from 15 to 65, in which hww is the half band width value in $\mu$m Of a white line reproducing a white line having a width of one pixel.

The image forming method wherein the value of (hwb−r) in thus obtained image in the yellow image-forming layer is smallest.

The image forming method wherein the value of (hww−r) in thus obtained image in the yellow image-forming layer is largest.

The image forming method wherein the ratio of the largest hwb value ($hwb_{max}$) to the smallest hwb value ($hwb_{min}$), $hwb_{max}/hwb_{min}$, among each of the color image-forming layers is within the range of from 1.0 to 1.1.

The image forming method-wherein the ratio of the largest hww value ($hww_{max}$) to the smallest hww value ($hww_{min}$), $hww_{max}/hww_{min}$, among each of the color image-forming layers is within the range of from 1.0 to 1.1.

The image forming method wherein the ratio of the hwb value to a fwb value, hwb/fwb, of thus obtained image in each of the color-forming layers is within the range of from 0.3 to 0.4, in which fwb is a width value at the legs in/$\mu$m of a line reproducing the line having a width of one pixel.

The image forming method wherein the ratio of the hww value to a fww value, hww/fww, of thus obtained image in each of the color-forming layers is within the range of from 0.3 to 0.4, in which the fww is a width value at the legs in $\mu$m of a white line reproducing the line having a width of one pixel.

DETAILED DESCRIPTION OF THE INVENTION

In one of the embodiments of the invention, the difference of the half band width of the line formed by exposing by scanning by a light beam having a pixel size of r $\mu$m for a time of not more than $10^{-3}$ seconds, and developing a silver halide color photographic material and the r is within the range of from 0 to 50.

When digitized image information is handled, the original image is generally separated into fine squares and the image information is digitized and processed for each of the squares. In the invention, the original image is separated into the fine squares and the minimum unit of the digitized image information is processed as one pixel, and the length of one side of the square ideally reproduced on the print is defined as the pixel size r in μm. Consequently, the pixel size is a value depending on the digital exposing apparatus and not depending on the input apparatus. For example, when image information read by a scanner with a resolving power of 720 dpi is printed out by a digital exposing apparatus having a resolving power of 200 dpi, the pixel size r is 127 μm, in which dpi is the number of dot per 2.54 cm. The pixel size r is not necessarily coincides with light beam diameter of the digital exposure apparatus since there are cases that exposure is conducted by overlapping main scanning line (raster) at certain ratio by light beam. In the invention the pixel size is determined by taking the overlapping of raster into consideration. For example, transportation pitch in a subscanning direction during one pass of main scanning corresponds to pixel size r and a square having side of r in length in case of scanning exposure method employing polygon mirror.

The exposure time per pixel can be considered as the time controlling the brightness of light beam or the irradiation period according to the digital date of one pixel.

Though the pixel size r is not restricted specifically in the invention, the pixel size r is preferably 40 to 150 μm, and more preferably 60 to 125 μm, in view of competency of image reproducing property of fine image and productivity (exposure seed).

In the invention, the hwb value represents the half band width value in μm of the line formed by exposing with a light beam having a width of the one pixel and developing a silver halide color photographic light-sensitive material. To output the one pixel width fine line, image data of black fine line, (R,G,B)=(0, 0, 0), having a width of one pixel is prepared by Photoshop 5.0 of Adobe Co. Ltd. so as to fit the resolving power of the output apparatus. The black line output according to the image information is scanned in the direction being at right angles with the fine line to measure the density by a microdensitometer PDM-5AR, manufactured by Konica Corp., using a blue, green or red Wratten filter. The half band width value of the fine line hwb is determined by the width of line at the intermediate density of the density of non image area or minimum density and the maximum density of the image area for each of the yellow, green and red components of the fine line.

Generally, the scanning exposure is performed by a combination of a line-shape exposure by a light beam, a luster exposure or main scanning, and a relatively moving of the light-sensitive material in the direction being at right angles with the direction of the line-shape exposure. For example, a drum method in which the light-sensitive material is fixed on outside or inside a cylindrical drum, and the drum is rounded while the light beam is irradiated for main scanning and the light source is moved in the direction being at right angles for subscanning, and a polygon mirror method in which the light-sensitive material is subjected to the horizontal main scanning by the light beam reflected by a rotated polygon mirror and the light-sensitive material is moved for the direction being at right angles with direction of the rotation of the polygon mirror, are frequently used. The case of an exposing apparatus having an array of light sources is included in the invention hence the array of light sources can be considered as the parts corresponding to the main scanning device.

Known light sources such as a light emission diode LED, a gas laser, a semiconductor laser LD, and a combination of a LD or a solid laser using a LD as the exciting light source with a second harmonics generating element so called SHG element may be used as the light source, are usable as the light source in the invention.

In the invention, the sample to be determine the hwb value is prepared by the following procedure: a light-sensitive material is exposed for forming the fine line image of one pixel width by the foregoing method and developed by the following color developer, CD-1, at 37±0.5° C. for 45 seconds. A bleach-fixing process and washing or stabilizing treatment are performed after the development process. The time from the finish of the exposure to the start of the development is within the range of from 20 to 30 seconds.

| Color Developer CD-1 | |
|---|---|
| Purified water | 800 ml |
| Triethylene diamine | 2 g |
| Diethylene glycol | 10 g |
| Potassium bromide | 0.02 g |
| Potassium chloride | 4.5 g |
| Potassium sulfite | 0.25 g |
| N-ethyl-N-(β-methanesulfonamidoethyl)-3-methyl-4-aminoaniline sulfate | 4.0 g |
| N,N-diethylhydroxylamine | 5.6 g |
| Triethanolamine | 10.0 g |
| Sodium diethylenetriaminepentaacetate | 2.0 g |
| Potassium carbonate | 30 g |
| Water to make | 1 l |

Adjust pH to 10.1 by sulfuric acid or potassium hydroxide.

A preferred embodiment of the invention comprises the steps of exposing a silver halide color photographic light-sensitive material comprising a support having thereon a yellow image-forming layer, a magenta image-forming layer and a cyan image-forming layer each containing light-sensitive silver halide by scanning with a light beam having a pixel size of r μm for a time of not more than $10^{-3}$ seconds per pixel, and developing the silver halide color photographic light-sensitive material, wherein the difference of a hww value in thus obtained image in each of the color-forming layers and the value of r is within the range of from 15 to 65, in which the hww is the half band width in μm of a white line reproducing the white line having a width of one pixel.

In the invention, the hww value is a half band width in μm of a white fine line formed by exposing a silver halide photographic material so that a white line having a width of one pixel, the minimum unit of exposure, is formed on the black background, and developing the light-sensitive material. To output the white line, data of a black solid image,. (R,G,B)=(0, 0, 0), having a size of 5 cm×5 cm in the center of which a white line, (R,G,B)=(255, 255, 255), having a width of one pixel is arranged, is prepared for fitting the resolving power of the output apparatus using Photoshop 5.0, Adobe Co., Ltd. The white line output according to the data is scanned by the microdensitometer PDM-5AR, Konica Corp., using a blue, green or red Wratten filter in the direction being at right angles with the direction of the white line to determined the density profile near the white line. The hww value is defined by the width of the white line is determined at an intermediate density between the minimum density and the density of solid image for each of the yellow-, green- and red-component.

A preferred embodiment of the invention is characterized in that the hwb value in the yellow image-forming layer is smallest when the light-sensitive material is scanned by a light beam so that the exposing time is not more than $10^{-3}$ seconds per pixel and processed, in which the hwb value is the half band width in μm of a fine line reproducing the line having one pixel width. The hwb value can be determined according to the foregoing procedure. When a print is visually observed, on which yellow, magenta and cyan monochrome fine lines each having the same hwb values are output, the yellow fine line tends to be recognized so that the width thereof is larger hence the outline of the yellow line is not clear. On the other hand, the scanning ununiformity tends to be formed when the hwb value is excessively reduced while maintaining the exposure resolving power. However, the scanning ununiformity tends to be difficultly recognized in the yellow image-forming layer compared with the magenta and cyan image-forming layer. According to the above two viewpoints, the black fine line is appeared as neutral or deep bluish black in the print sample prepared under a condition so that the hwb value of the yellow image-forming layer is made smallest. As a result of that, a beautiful character reproduction without blur can be realized and the scanning ununiformity is also almost not recognized.

A preferred embodiment of the invention is characterized in that the hww value in the yellow image-forming layer is largest when the light-sensitive material is scanned by a light beam so that the exposing time is not more than $10^{-3}$ seconds per pixel and processed, in which the hww value is the half band width in μm of a white line reproducing the line having one pixel width. The hww value can be determined by the foregoing procedure. When a print on which white fine lines respectively on the yellow, magenta or cyan background each having the same hww values are output, is visually observed, the white fine line on the yellow background tends to be recognized so that the width thereof is smaller hence the outline of such the white line is not clear. On the other hand, the scanning ununiformity tends to be formed when the hww value is excessively increased while maintaining the exposure resolving power. However, the scanning ununiformity tends to be difficultly recognized in the yellow image-forming layer compared with the magenta and cyan image-forming layer. According to the above two viewpoints, the edge of the white fine line is appeared as neutral or deep bluish black in the print sample prepared under a condition so that the hww value of the yellow image-forming layer is made largest. As a result of that, a beautiful white character on the black background without blur can be reproduced and the scanning ununiformity is also almost not recognized.

A preferred embodiment of the invention is characterized in that the ratio of the largest hwb value $hwb_{max}$ to the smallest hwb value, $hwb_{min}$, $hwb_{max}/hwb_{min}$, among the hwb values of the respective color image-forming layers is within the range of from 1.0 to 1.1, when the light-sensitive material is scanned by a light beam so that the exposing time is not more than $10^{-3}$ seconds per pixel and processed, in which the hwb value is the half band width in μm of a fine line reproducing the line having one pixel width. The hwb value can be determined according to the foregoing procedure. When the ratio of $hwb_{max}/hwb_{min}$ is more than 1.1, a color blur at the edge of the black fine line tends to be observed and the scanning ununiformity caused by the scanning of a specific color tends to be formed in the uniformly exposed area. It is a preferable embodiment that the ratio of $hwb_{max}/hwb_{min}$ is not more than 1.05. In such the case, the reproducibility of character is raised and the ununiformity of scanning is inhibited so that the effect of the invention is enhanced.

A preferred embodiment of the invention is characterized in that the ratio of the largest hww value $hww_{max}$ to the smallest hww value $hww_{min}$, $hww_{max}/hww_{min}$, among the hwb values of the respective color image-forming layers is within the range of from 1.0 to 1.1, when the light-sensitive material is scanned by a light beam so that the exposing time is not more than $10^{-3}$ seconds per pixel and processed, in which the hww value is the half band width in μm of a white fine line reproducing the line having one pixel width. The hww value can be determined according to the foregoing procedure. When the ratio of $hww_{max}/hww_{min}$ is more than 1.1, a color blur at the edge of the white fine line on the uniform black background tends to be observed and the scanning ununiformity of a specific color tends to be formed in the uniformly exposed area. It is a preferable embodiment that the ratio of $hww_{max}/hww_{min}$ is not more than 1.05. In such the embodiment, the reproducibility of white character is raised and the ununiformity of scanning is inhibited so that the effect of the invention is enhanced.

A preferred embodiment of the invention is characterized in that the ratio of the hwb value to the fwb value, hwb/fwb, is within the range of from 0.3 to 0.4 when the light-sensitive material is scanned by a light beam so that the exposing time is not more than $10^{-3}$ seconds per pixel and processed, in which the hwb value is the half band width in μm of a fine line reproducing the line having one pixel width and the fwb value is the line width in μm at the legs of density profile thereof.

In the invention, the fwb value is defined by the width of the fine line at the legs portion of the density profile of the line reproduced by exposing the light-sensitive material to a line having one pixel (the minimum unit of exposure) width, and processing. To output the one pixel width fine line, image data of black, (R,G,B)=(0, 0, 0), fine line having a width of one pixel is prepared by Photoshop 5.0, Adobe Co. Ltd. so as to fit the resolving power of the output apparatus. The black line output according to the image information is scanned in the direction being at right angles with the fine line to measure the density by a microdensitometer PDM-5AR, manufactured by Konica Corp., using a blue, green or red Wratten filter. The density of non image area or the minimum density and the maximum density of the line image are determined on the density profile of each of the yellow, green and red component of the fine line. The fwb value is defined by the distance between the two points on the density profile of the line each having a density of (Minimum density+0.06×(Maximum density−Minimum density)).

When the ratio of hwb/fwb is less than 0.3, the black character image tends to be blurred even though the scanning ununiformity is inhibited. When the ratio of hwb/fwb is more than 0.4, the line-shape canning ununiformity is tends to be formed. It is one of preferable embodiment of the invention that the hwb/fwb ratio in the cyan image-forming layer is largest among those in the yellow, magenta and cyan image-forming layers.

A preferred embodiment of the invention is characterized in that the ratio of the hww value to the fww value, hww/fww, is within the range of from 0.3 to 0.4 when the light-sensitive material is scanned by a light beam so that the exposing time is not more than $10^{-3}$ seconds per pixel and processed, in which the hww value is the half band width in μm of a white fine line reproducing the line having one pixel width and the fww value is the white line width in μm at the legs of density profile thereof.

In the invention, the fww value is defined by the width of the white fine line at the legs portion of the density profile of the line reproduced by exposing the light-sensitive material to a white line having one pixel (the minimum unit of exposure) width, and processing. To output the white line, data of a black solid image, (R,G,B)=(0, 0, 0), having a size of 5 cm×5 cm in the center of which a white line, (R,G,B)=(255, 255, 255), having a width of one pixel is arranged, is prepared to fit the resolving power of the output apparatus using Photoshop 5.0, Adobe Co., Ltd. The white line output according to the data is scanned by the microdensitometer PDM-5AR, Konica Corp., using a blue, green or red Wratten filter in the direction being at right angles with the direction of the white line to determined the density profile near the white line. The minimum density of the white line and the maximum density of the background area are determined on the density profile of each of the yellow, green and red component of the fine line. The fww value is defined by the distance between the points each having a density of (Minimum density+0.06×(Maximum density Minimum density)) on the density profile of the line.

When the ratio of hww/fww is less than 0.3, the white character image tends to be not resolved. On the other hand, when the hww/fww is more than 0.4, the scanning noise line tends to be formed in the uniform background even though the white character on the colored background is become clearly observed. It is one of preferable embodiment of the invention that the hwb/fwb ratio of the cyan image-forming layer is smallest among the yellow, magenta and cyan image-forming layers.

A preferred embodiment of the invention is characterized in that the ratio of the gradation $\gamma_a$ of an image obtained by one shot exposing for 0.5 seconds and processing the light-sensitive material to the gradation $\gamma_d$ of an image obtained by exposing the light-sensitive material to a light beam so that the exposing time is $10^{-3}$ seconds per pixel and processing, $\mu_a/\gamma_d$, is within the range of from 1.0 to 1.15.

In the invention, the gradient of each of the color image-forming layers is determined by exposing and processing the light-sensitive material so that the color image is formed only one image-forming layer. The exposure to form the color image in only one image-forming layer means an exposure necessary to form the color image substantially only one image-forming layer and the fog in the nor exposed layers and the some color contamination caused by the interlayer diffusion of the oxidation product of a color developing agent are ignored.

In the invention, the gradation is defined as the gradient of a straight line connecting a point of reflective density of 1.0 and that of 1.5 on a characteristic curve of the light-sensitive material.

In the invention, $\gamma_d$ can be determined according to a relation curve of the exposure amount and the density or a characteristic curve which is obtained by the following procedure: the light-sensitive material is exposed to a light beam using a digital exposing apparatus adjusted so that the exposure time per pixel is not more than $10^{-3}$ seconds, the exposure amount is changed stepwise. The light-sensitive material is processed using the foregoing color developer CD-1. The density of each of the steps of thus obtained monochrome image is measured and the characteristic curve is drawn according to the measured data.

The $\gamma_a$ can be obtained in the same manner as for determining $\gamma_d$ except that the light-sensitive material is exposed to an exposure for 0.5 seconds through an optical wedge.

When the ratio of $\gamma_a/\gamma_d$ is larger than 1.15, information at the high light area or the shadow area of the image formed by the exposure through a negative film tends to be lost, or a blur at the edge of the character exposed by the digital exposing apparatus tends to be easily formed. It is preferable embodiment of the invention that the ratio of $\gamma_a/\gamma_d$ is within the range of from 1.0 to 1.05. In such the case, the reproducibility of character image is improved and the formation of the ununiformity in scanned image is inhibited, furthermore, a beautiful print can be obtained by either ways of exposure by the digitized information or exposure through a negative film on which image information is recorded.

A preferred embodiment of the invention, the ratio of the gradation $\gamma_x$ of an image formed in each of the image forming-layers by exposing a light-sensitive material to a flash exposure for $10^{-6}$ seconds and processing the light-sensitive material to the gradation $\gamma_d$ of an image formed in each of the image-forming layers by exposing the light-sensitive material to a exposure by light beam scanning for not more than $10^{-3}$seconds, $\gamma_x/\gamma_d$, is within the range of from 0.8 to 1.0.

In the invention, $\gamma_x$ can be determined by the following procedure; the light-sensitive material is exposed by using a combination of a light source adjusted so that the light emission time thereof is not more than $10^{-6}$ seconds, and optical wedge and a color filter, and processed by using the foregoing color developer CD-1. The density of thus obtained monochrome image is measured at each the step and a characteristic curve showing the relation between the exposure amount and the image density is drawn. The $\gamma_x$ is determined according to the characteristic curve.

When the $\gamma_x/\gamma_d$ value is smaller than 0.8, the character quality or ununiformity formation in the scanned image tend to be changed depending on the difference of the light source or that of the multiplicity of exposure of the digital exposing apparatus. It is preferable embodiment of the invention that the ratio of $\gamma_x/\gamma_d$ is within the range of from 0.95 to 1.0 since the effect of the invention that the good print can be obtained without the influence of the kind of digital exposing apparatus is enhanced.

The requirements of the invention can be satisfied, for example, by optimally controlling properties of the light-sensitive silver halide contained in the light-sensitive material, by optimally controlling the amount of light-sensitive silver halide or that of coupler coated on the light-sensitive material, even though there is no limitation on the means for satisfying the requirements of the invention. The above-mentioned means may be applied singly or in combination.

Silver halide to be used in the light-sensitive material relating the invention may be has any composition such as silver chloride, silver bromide, silver chlorobromide, silver iodobromide, silver iodochlorobromide and silver chloroiodide. Among them silver chlorobromide containing not less than 95 mol-% of silver chloride is preferable hence the effect of the invention is enhanced. A silver halide emulsion containing not less than 97 mol-% is preferable and that containing from 98 to 99.9 mol-% of silver chloride is particularly preferable from the viewpoint of rapidity and the stability of processing.

In the light-sensitive material relating to the invention, a silver halide emulsion comprising a silver halide grain locally having a portion containing a high concentration of silver bromide can also be preferably used for reducing the hwb value and increasing the hww value and inhibiting the blur of the character image. In such the case, the portion containing a high concentration of silver bromide may be contacted with the grain in an epitaxially form or in a core/shell form. Moreover, the high silver bromide containing portion may be existed on the grain surface in a form of area having a different composition without formation of a complete covering layer. The a composition may be varied continuously or discontinuously. It is particularly preferable that the portion containing a high concentration of silver bromide is existed at the surface or the corner of the crystal grain.

In the light-sensitive material relating to the invention, it is preferable to use a silver halide grain containing a heavy metal ion for reducing the hwb value or increasing the hww value to reduce the blur of character image. Examples of the heavy metal ion usable for such the purpose include an ion of a metal of the Group VIII to Group X such as ion, iridium, platinum, palladium, nickel, rhodium, osmium, ruthenium and cobalt, a transition metal of Group XII such as cadmium, zinc and mercury, and an ion of lead, rhenium, molybdenum, tungsten, gallium and chromium. Among them, an ion of iron, iridium, platinum, ruthenium, gallium and osmium are preferable. Such the metal ion may be added to the silver halide emulsion in a form of a salt or a complex salt.

When the heavy metal ion constitutes a complex salt, examples of the ligand or ion of the complex salt may be a cyanide ion, a thiocyanate ion, a cyanate ion, an isothiocyanate ion, a chloride ion, a bromide ion, an iodide ion, a nitrate ion, a carbonyl group and ammonia. Among them, the cyanide ion, thiocyanate ion, isothiocyanate ion, chloride ion and bromide ion are preferable.

To contain the foregoing heavy metal ion into the silver halide grain, the heavy metal compound is added at an optional step such as before the formation of silver halide grain, in the process of silver halide grain formation, after the formation of silver halide grain, and in the course of physical ripening. The addition of the heavy metal compound solution may be continuously performed in the whole or a part of the grain formation process.

The amount of the heavy metal ion to be added to the silver halide emulsion is preferably from $1\times10^{-9}$ moles to $1\times10^{-2}$ moles, more preferably from $1\times10^{-8}$ moles to $5\times10^{-5}$ moles, per mole of silver halide.

A silver halide grain having an optional shape can be used in the light-sensitive material relating to the invention. A preferable example is a cubic grain having a (100) face at the surface thereof. A grain having a shape of octahedral, tetradecahedral or dodecahedral may be used, which can be prepared according to the descriptions of U.S. Pat. Nos. 4,183,756 and 4,225,666, JP O.P.I. No. 55-25689, Japanese Examined Patent Publication No. 55-42737 and J. Photogr. Sci., 21, 39 (1973). A silver halide grain having twin faces may also usable.

Silver halide grains having a uniform shape are preferably used in the light-sensitive material relating to the invention. It is more preferable that two or more kinds of monodisperse silver halide emulsion are added in the same layer. The diameter of the silver halide grain is preferably from 0.1 to 1.2 $\mu$m, more preferably from 0.2 to 1.0 $\mu$m, from the view point of photographic properties such as rapid processing adaptability and light-sensitivity, although there is no limitation on the diameter of the silver halide grain. The grain diameter can be determined by a projection area or an approximate value of diameter. When the shapes of the grain are substantially the same, the grain size distribution can be quite exactly expressed according to the diameter or the projection area of the grains.

The-silver halide grains to be used in the light-sensitive material relating to the invention are preferably monodisperse grains having a size distribution variation coefficient of from 0.22 to 0.15. It is more preferable that two or more kinds of monodisperse emulsion each having a size distribution variation coefficient of not more than 0.15. The variation coefficient is a coefficient representing the breadth of the size distribution, which is defined by the following equation.

$$\text{Variation Coefficient}=S/R$$

wherein S is a standard deviation of the grain size distribution and R is an average grain diameter.

The grain diameter is the length of a side of cubic grain or the diameter of spherical grain. Regarding a grain having a shape other than cubic or spherical, the diameter is expressed by the diameter of a circle having an area the same with the projection are of the grain.

For preparation of the silver halide emulsion, various apparatus and methods known in the field of the photographic industry can be used.

The silver halide emulsion to be used in the light-sensitive material relating to the invention may be any of ones prepared by an acid method, a neutral method or an ammoniacal method. The silver halide grain may be either one grown at once or one grown from a seed grain. The method for preparing the seed grain and that to grow the grain may be the same or different. A normal mixing method, a reversal mixing method, a double-jet mixing method and a combination thereof may be applied as the method for reacting a soluble silver salt and a soluble halide. The emulsion prepared by the double-jet method is preferable. The pAg controlled double-jet method described in JP O.P.I. No. 54-48521 can also be applied as a form of the double-jet method.

The apparatus described JP O.P.I. Nos. 57-92523 and 57-92524 in which the water-soluble silver salt solution and the water-soluble halide solution are supplied through an adding device arranged in the mother liquid, the apparatus described in German Paten OSL No. 2,921,164 in which the water-soluble silver salt solution and the water-soluble halide solution are supplied while the concentration of each solution are continuously varied and the apparatus described in Japanese Patent Examined Publication 56-501776 in which the reaction mother liquid is take out from the reaction vessel and concentrated by an ultrafiltration so that the silver halide grains is grown while the distance between the grains is held at a constant are also usable. A silver halide solvent such as a thioether may be used if it is necessary. Moreover, an additive such as a compound having a mercapto group, a nitrogen-containing heterocyclic compound and a sensitizing dye may be added in the course of or after the formation of silver halide grain.

A combination of a sensitization using a gold compound and that using a chalcogen sensitizer may be applied to the silver halide emulsion to be used in the light-sensitive material relating to the invention. A sulfur sensitizer, a selenium sensitizer and a tellurium sensitizer may be used as the chalcogen sensitizer to be applied to the silver halide emulsion. Among them, the sulfur sensitizer is preferably to be used. Examples of the sulfur sensitizer include a thiosulfate, allylthiocarbamidothiourea, allyl isothiocyanate, cystine, p-tolluenethiosulfonate, rhodanine and elemental sulfur. The amount of the sulfur sensitizer is preferably changed depending on the kind of silver halide or the expected strength of the sensitizing effect. The amount is preferably from $5\times10^{-10}$ from $5\times10^{-5}$ moles, more preferably from $5\times10^{-8}$ to $3\times10^{-5}$ moles per mole of silver halide.

Examples of the gold sensitizer include chloroauric acid, gold sulfide and various gold complexes. Examples of the ligand compound of the gold complex include dimethylrhodanine, thiocyanate, mercaptotetrazole and mercaptotriazole. The amount of the gold compound to be used may be changed depending on the kind of silver halide, the kind of gold compound and the ripening condition, and the amount is preferably from $1\times10^{-8}$ to $1\times10^{-4}$ moles, more preferably from $1\times10^{-8}$ to $1\times10^{-5}$ moles, per mole of silver halide. A reduction sensitization may be applied for chemically sensitizing the silver halide emulsion.

A known fog inhibitors or a stabilizing agent may be used in the silver halide emulsion to be used in the light-sensitive material relating to the invention for reducing the change of the properties in the course of storage, or inhibiting fogging in the developing process. Examples of the compound preferably used for such the purpose include the compounds represented by Formula (II) described in JP O.P.I. No. 2-146036, page 7, lower column, and examples of more preferable compound include compounds IIa-1 to IIa-8 and IIb-1 to IIb-7 described in the same publication, 1-(3-methoxyphenyl)-5-mercaptotetrazole and 1-(4-ethoxyphenyl)-5-mercaptoterazole. Theses compounds are added at the grain formation process, chemical ripening process, finishing time of chemical ripening or the coating liquid preparation process of the silver halide emulsion according to the purpose of the addition. The compound is preferably used in an amount of from $1\times10^{-5}$ to $5\times10^{-3}$ moles per mole of silver halide when the chemical sensitization is performed in the presence of the compound. When the compound is added at the finishing time of chemical sensitization. When the compound is added at the coating liquid preparation process, the amount thereof is preferably from $1\times10^{-6}$ to 1×10–2 moles, more preferably from $1\times10^{-5}$ to $1\times10^{-3}$ moles, per mole of silver halide. When the compound is added to the silver halide emulsion layer in the coating liquid preparation process, the amount thereof is preferably from $1\times10^{-6}$ to $1\times10^{-1}$ moles, more preferably from $1\times10^{-5}$ to $1\times10^{-2}$ moles, per mole of silver halide. When the compound is added to a layer other than the silver halide emulsion layer, the preferable amount of the compound is from $1\times10^{-9}$ to $1\times10^{-3}$ moles per square meter of the coated layer.

Dyes each having absorption at various wavelength may be used in the light-sensitive material relating to the invention for preventing irradiation or halation. Although known compounds may be used for such the purpose, the dyes having an absorption in the visible region AI-1 to AI-11 described in JP O.P.I. No. 3-251840, page 308, those described JP O.P.I. Nos. 6-3770 and 11-119379 are preferably used. As the infrared absorption dye, the compounds represented by Formulas (I), (II) and (III) described in JP O.P.I. No. 1-280750, page 2; lower left column, are preferable hence they have preferable spectral absorption property and influence thereof on the photographic properties is small and the stain of remaining color is not caused.

It is preferable embodiment that the silver halide color photographic light-sensitive material has one peak of spectral absorption within the region of 630 to 730 nm and the dye is added so that the reflected light amount at 670 nm is not more than 10% of the incident light amount for rising the sharpness of image in both case of the digital exposure for very short time with a very high intensity such as the laser exposure and the analogue exposure through a negative image.

A fluorescent whitening agent is preferably added to the light-sensitive material relating to the invention, by which the whiteness of the background is improved. Examples of preferably usable compounds include those represented by Formula II described in JP O.P.I. No. 2-232652.

The light-sensitive material relating to the invention has layers each containing a yellow, magenta and cyan coupler, respectively, in combination with a silver halide emulsion spectrally sensitized at a specific region of wavelength of from 400 to 900 nm. The silver halide emulsion contains one or more kind of sensitizing dye in combination.

Known spectral sensitizing dyes can be used for spectrally sensitizing the silver halide emulsion to be used in the light-sensitive material relating to the invention without any limitation. SB-1 through SB-8 described in JP O.P.I. No. 3-251840, page 28, are preferably used singly or in combination as the blue sensitizing dye. GS-1 through GS-5 described on page 28 of the same publication are preferably used as the green sensitizing dye. RS-1 through RS-8 described on page 29 of the same publication are preferably used as the red sensitizing dye. The use of an ah infrared sensitizing dye is necessary when the imagewise exposure is performed by infrared light using a semiconductor laser. As the infrared sensitizing dye, IRS-1 through IRS-11 described on pages 6 to 8 of JP O.P.I. No. 4-285950 are preferably used. It is preferable that a supersensitizer such as SS-1 through SS-9 described in JP O.P.I. No. 4-285950, pages 8 to 9, and S-1 through S-17 described in JP O.P.I. No. 5-66515, pages 15 to 17, is used in combination with the infrared, red, green or blue sensitizing dye. The sensitizing dye may be added to the silver halide emulsion at an optional step between the silver halide formation and the finishing of chemical sensitization. The sensitizing dye may be added in a form of a solution in a water-miscible solvent such as methanol, ethanol, fluorized alcohol, acetone and dimethylformamide, or water, or in a form of dispersion.

Any compound capable of coupled with the oxidation product of a color developing agent to form a coupling product having the maximum spectral absorption at a wavelength of not less than 340 nm. A yellow coupler forming a dye having the maximum absorption at a wavelength of from 350 to 500 nm, a magenta coupler forming a dye having the maximum absorption at a wavelength of from 500 to 600 nm and cyan coupler forming a dye having the maximum absorption at a wavelength of from 600 to 750 nm are typically used.

Examples of the cyan coupler preferably used in the light-sensitive material relating to the invention include couplers represented by Formulas (C-I) and (C-II) described in JP O.P.I. No. 4-114154, page 5, lower left column, concrete examples of such the compound are described as CC-1 through CC-9 at page 5, lower right column, to page 6, lower left column, of the same publication.

Examples of the magenta coupler preferably used in the light-sensitive material relating to the invention include couplers represented by Formulas (M-I) and (M-II) described in JP O.P.I. No. 4-114154, page 4, upper right column, concrete examples of such the compound are described as MC-1 through MC-11 at page 4, lower left column, to page 5, upper right column, of the same publication. The couplers represented..by Formula (M-I) described at page 4, are more preferable. Among them, the couplers having a tertiary alkyl group as the group represented by RM in Formula (M-I) is particularly preferable. MC-8 through MC-11 described at page 5, upper column, of the same publication are preferable since they are excellent in the color reproducibility in the region of from blue to purple and red, and also show excellent detail expression ability.

Examples of the yellow coupler preferably used in the light-sensitive material relating to the invention include couplers represented by Formula (Y-I) described in JP O.P.I. No. 4-114154, page 3, upper right column, concrete examples of such the compound are described as YC-1 through YC-9 at page, lower left column of the same publication. The couplers each having an alkoxyl group as RY1 in Formula (Y-I) and the couplers represented by Formula [I] described in JP O.P.I. No. 6-67388 are more preferable since a desirable yellow tone can be reproduced by such the couplers. Among them, examples of particularly preferable compound include YC-8 and YC-9 described at page 4, lower left column, and the compounds Nos. (1) through (47) described at pages 13 to 14 of JP O.P.I. No. 6-67388. The most preferable compound is ones represented by Formula [Y-1] described at page 1, and pages 11 to 17 of JP O.P.I. No. 4-81847.

When an oil in water type dispersion method is applied for addition of the coupler or another organic compound into the light-sensitive material relating to the invention, the coupler or another organic compound is dissolved in a water-insoluble high-boiling solvent having a boiling point of not less than 150° C. A low-boiling solvent and/or a water-miscible organic solvent may be used in combination with the high-boiling solvent according to necessity. Thus obtained solution is dispersed in a hydrophilic binder such as a solution of gelatin using a surfactant. A stirrer, a homogenizer, a colloid mill, a flow jet mixer and an ultrasonic dispersing apparatus can be for dispersing means. A process for removing the low-boiling solvent may be inserted after or in the course of the dispersion. Examples of the high-boiling solvent preferably usable for dissolving and dispersing the coupler include a phthalic acid ester such as dioctyl phthalate, diisodecyl phthalate and dibutyl phthalate, a phosphoric acid ester such-as tricresyl phosphate and trioctyl phosphate. The dielectric constant of the high-boiling solvent is preferably from 3.5 to 7.0. Two or more kinds of the high-boiling solvent can be used in combination.

A method in which a water-insoluble and organic solvent-soluble polymer is dissolved in the low-boiling solvent and/or the water-miscible organic solvent according to necessity and dispersed in the hydrophilic binder such as the gelatin solution by various dispersing means using the surfactant, in stead of the method using the high-boiling solvent. In such the method, the high-boiling solvent may be used in combination. Example of the water-insoluble and organic solvent-soluble polymer includes poly(N-t-butylacrylamide).

Examples of the preferable surfactant to be used for dispersing the additives or controlling the surface tension of the coating liquid include a compound having a hydrophobic group having 8 to 30 carbon atoms and a sulfonic acid group in the molecular thereof. Concrete examples are A-1 through A-11 described in JP O.P.I. No. 64-26854. A surfactant having a fluorine atom in the alkyl group thereof is also preferably used. The dispersion is ordinarily added to the coating liquid containing the silver halide emulsion. The interval between the preparation of the dispersion to the addition to the coating liquid and that between the additions to the coating of the coating liquid is preferably to be short. Each of the intervals is preferably not more than 10 hours, more preferably not more than 3 hours, further preferably not more than 20 minutes.

A decoloration preventing agent is preferably used together with the coupler to prevent the decolorization of the formed dye image caused by light, heat and humidity. Examples of compound preferably used for the magenta dye include the phenyl ether compounds represented by Formula I or II described in JP O.P.I. No. 2-66541, page 3, the phenol compounds represented by Formula IIIB described in JP O.P.I. No. 3-174150, the amine compounds represented by Formula A described in JP O.P.I. No. 64-90445, and the metal complexes represented by Formula XII, XIII, XIV or XV described in JP O.P.I. No. 62-182741. The compounds represented by Formula I' described in JP O.P.I. No. 1-196049 and the compounds represented by Formula II described in JP O.P.I. No. 5-11417 are particularly preferable for the yellow dye and the cyan dye.

A compound such as (d-11) described in JP O.P.I. No. 4-114154, page 9, lower left column, and that such as (A'-1) described in at page 10, lower left column, of the same publication can be used for shifting the absorption wavelength of the formed dye. Other than the above, the fluorescent dye releasing compound described in U.S. Pat. No. 4,774,187 can be used.

In the light-sensitive material relating to the invention, it is preferable that a compound capable of reacting with the oxidation product of a color developing agent is added into an interlayer arranged between the light-sensitive layers for preventing the color contamination or into the silver halide emulsion layer for improving the fogging. A hydroquinone derivative is suitable for such the compound, and a dialkylhydroquinone such as 2,5-t-octylhydroquinone is preferable. Particularly preferable compounds are those represented by Formula II described in JP O.P.I. No. 4-133056, in concrete, compounds II-1 through II-14 described at pages 13 to 14 and compound 1 described at page 17 of the publication.

In the light-sensitive material relating to the invention, it is preferable to add a UV-absorbent for preventing the static fog and improving the resistivity of the dye image against light. Examples of preferable UV-absorbent include a benzotriazole compound. The compounds represented by Formula III-3 described in JP O.P.I. No. 1-250944, those represented Formula III described in JP O.P.I. No. 64-66646, UV-1L through UV-27L described in JP O.P.I. No. 63-187240, compounds represented by Formula I described I JP O.P.I. No. 4-1633 and those represented by Formula (I) or (II) described in JP O.P.I. No. 5-165144 are particularly preferable.

Although gelatin is advantageously used as a binder in the light-sensitive material relating to the invention, a hydrophilic colloid such as another kind of gelatin, a gelatin derivative, a graft polymer of gelatin and another high molecular weight substance, a protein other than gelatin, a sugar derivative, a cellulose derivative, and a synthesized high molecular weight substance such as homo- or co-polymer are usable.

A vinylsulfon type hardener and a chlorotriazine type hardener are preferably used for hardening the binders. In concrete, the compounds described in JP O.P.I. Nos. 61-249054 and 61-245153 are preferably used. It is preferable to add a mold preventing agent or a preservative described in JP O.P.I. No. 3-157646 into the colloid layer to prevent breeding the mold and bacterium which exert a bad influence on the photographic property and the storage ability of the image. It is preferable to add a lubricant or matting agent described in JP O.P.I. Nos. 6-118543 and 2-73250 for improving the surface property of the light-sensitive material before of after the processing.

Any material can be use for the support of the light-sensitive material relating to the invention, for example, paper laminated with polyethylene of polytethylene terephthalate), a paper support composed of natural pulp or synthesized pulp, a poly(vinyl chloride) sheet, a polypropylene or poly(ethylene terephthalate) support which may contain a white pigment and baryta paper can be used as the support. Among them, a support composed of raw paper having water resistive resin laminating layers on both sides thereof is preferred. As the water resistive resin, polyethylene, poly(ethylene terephthalate) and their copolymer are preferred.

As the white pigment to be used in the support, an inorganic and/or organic white pigment, preferably inorganic white pigment, are usable. Examples of the white pigment include a sulfate of alkali-earth metal such as barium sulfate, a carbonate of alkali-earth metal such as calcium carbonate, a silica such as a fine powdered silica and a synthesized, calcium silicate, alumina, alumina hydrate, titanium oxide, zinc oxide, talk and clay, and barium sulfate and titanium oxide are preferred. The amount of the white pigment contained in the water resistive resin layer provided on the surface of the support is preferably not less than 13% by weight, more preferably not less than 15% by weight, for improving the sharpness of the image.

In the paper support to be used in the light-sensitive material relating to the invention, the dispersing degree of the white pigment can be measured by the method described in JP O.P.I. No. 2-28640. The dispersion degree of the white pigment is preferably not more than 0.20, more preferably not more than 0.15 in the variation coefficient described in the foregoing publication. It is preferable that the center line average roughness (SRa) of the support surface is not more than 0.15 $\mu$m. It is more preferably that the center line average roughness is not more than 0.12 $\mu$m since high surface glossiness can be obtained. It is preferable to add a small amount of a blue or red tinting agent such as ultramarine or an oil-soluble dye into the white pigment-containing water resistive resin or the coated hydrophilic colloid layer for controlling the balance of the spectral reflective density of the white background after processing to improve the whiteness.

In the light-sensitive material relating to the invention, the silver halide emulsion may be coated directly or through a subbing layer on the surface of the support treated with corona discharge, UV ray irradiation or flame. The subbing layer is one or two layers for improving the adhesiveness, ant-static property, dimension stability, friction resistivity, hardness, antihalation property, friction property and/or another property. For coating the silver halide emulsion layer, a thickener may be used for raising the suitability for coating. As the coating method, an extrusion coating and the curtain coating are particularly advantageous by which two or more kinds of layer can be simultaneously coated.

The invention is preferably applied to a light-sensitive material for forming a picture to be visually appreciated, for example, color paper, reversal color paper, a light-sensitive material for forming a positive image, a light-sensitive material for display and a light-sensitive material for color proof.

Compounds known as the aromatic primary amine developing agent can be used in the image forming method according to the invention. Examples of such the compound include N,N-diethyl-p-phenylenediamine, 2-amino-5-diethylaminotoluene, 2-amino-5-(N-ethyl-laurylamino) toluene, 4-{N-ethyl-N-(β-hydroxyethyl)amino}aniline, 2-methyl-4-{N-ethyl-N-(β-hydroxyethyl)amino}aniline, 4-amino-3-ethyl-N-ethyl-N-{β-(methanesulfonamido) ethyl}aniline, N-(2-amino-5-diethylaminophenylethyl) methanesulfonamide, N,N-dimethyl-p-phenylenediamine, 4-amino-3-methyl-N-ethyl-N-methoxyethyl-aniline, 4-amino-3-methyl-N-ethyl-N-(β-ethoxyethyl)aniline and 4-amino-3-methyl-N-ethyl-N-(γ-hydroxypropyl)aniline. Moreover, sulfonylhydrazide and carbonylhydrazide type color developing agents described in European Patent Publication Nos. 565,165, 572,054, and 593,110, JP O.P.I. Nos. 8-202002, 8-227131, 8-234390 and Japanese Patent Application No. 10-171335, and sulfonamidophenyl type color developing agent described in JP O.P.I. No. 11-149146 are also usable other than the aromatic primary amino color developing agent.

In the invention, the developing solution containing the foregoing color developing agent can be used at an optional pH value, and the pH value is preferably from 9.5 to 13.0, more preferably from 9.8 to 12.0, from the viewpoint of rapid processing.

The temperature of the processing solution of the color development is preferably from 35° C. to 70° C. Although a higher temperature is preferred for the short time processing, an excessively high temperature is not suitable from the viewpoint of the stability of the processing solution. Consequently, the processing is preferably performed within the range of from 37° C. to 60° C. In the invention, the color developing time is preferably not more than 35 seconds, more preferably not more than 25 seconds.

The duration from the finish of the scanning exposure to the start of the color development is preferably to be shorter from the viewpoint of a high producibility. However, the latent image formed by a short time exposure with high intensity light tends to be instable and the quality of character image tends to be varied when a silver halide emulsion having a high silver chloride content. In the image forming method according to the invention, the character image quality can be obtained with a relatively high stability even when the duration from the finish of the scanning exposure to the start of the color development is short. Accordingly, the short duration is a preferably embodiment. The duration from the finish of the scanning exposure to the start of the color development is preferably not more than 30 seconds, more preferably not more than 15 seconds.

In the color developing solution, known components of developing solution can be added in addition to the foregoing color developing agent. An alkali agent having a pH buffering ability, a chloride ion, a development inhibitor such as benzotriazole, a preservant and a chelating agent are ordinarily used.

An image forming method by a process so-called thermal development can also be preferably applied in the invention. In such the method, a light-sensitive material in which a compound capable of releasing a dye by reacting with the foregoing color developing agent or a precursor thereof, or by an oxidation-reduction reaction is preliminary added, is contacted with a processing sheet, in the presence of a small amount of a reaction aid such as water according to necessity, and developed by heating. The light-sensitive material is subjected to a bleaching treatment and a fixing treatment after the color development. The bleaching treatment and the fixing treatment may be performed simultaneously. A washing treatment is ordinarily applied after the fixing treatment. A stabilizing treatment may be applied in place of the washing treatment.

The processor to be used for processing of the light-sensitive material according to the invention may be either a roller-transport type in which the light-sensitive material is transported by rollers or an endless belt type in which the light sensitive material is fixed on an endless belt and transported. Moreover, a processor having a slit-shaped processing tank in which the light-sensitive material is transported together with the supplied processing solution, a spray processing method in which the processing solution is sprayed on the light-sensitive material, a web method in which the light-sensitive material is contacted with a carrier immersed with a processing solution, and a method using a viscous processing solution can be also applied.

When a lot of light-sensitive material is processed, the processing is ordinarily run. In such the processing, it is preferable that the amount of replenishing solution is smaller. The best embodiment of the processing from the viewpoint of the environment suitability is that the processing composition is replenished in a form of tablet, the method described in Journal of Technical Disclosure No. 94-16935 is most preferable. When the thermal development is applied, the bleaching and fixing treatment can be performed by a method, for example, in which the dye image is only transferred to anther sheet or a dye image receiving sheet.

EXAMPLES

The invention is described below according to examples.

Example 1

(Preparation of Blue-sensitive Silver Halide Emulsion Em-B1)

Into 1 liter of a 2% aqueous solution of gelatin kept at 40° C., the following Solution A and Solution B were simultaneously added while the pAg and pH were each kept at 7.3 and 3.0, respectively. Moreover, the following Solution C and Solution D were simultaneously added while the pAg and pH were each kept at 8.0 and 5.5, respectively. The control of the pAg was performed by the method described in JP O.P.I. No. 59-45437, and the control of pH was performed by the use of an aqueous solution of sulfuric acid or sodium hydroxide.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |
| (Solution C) | |
| Sodium chloride | 102.7 g |
| Potassium hexachloroiridate (IV) | $4 \times 10^{-8}$ moles |
| Potassium hexacyanoferrate (II) | $2 \times 10^{-5}$ moles |
| Potassium bromide | 1.0 g |
| Water to make | 600 ml |
| (Solution D) | |
| Silver nitrate | 300 g |
| Water to make | 600 ml |

After the addition, the emulsion was desalted by the use of 5% aqueous solution of Demol N, manufactured by Kao-Atlas Co., Ltd., and 20% aqueous solution magnesium sulfate. The desalted emulsion was mixed with an aqueous solution of gelatin. Thus a monodisperse cubic emulsion EMP-1A was prepared, which had an average grain diameter of 0.55 μm, a variation coefficient..of grain size of 0.07, and a silver chloride content of 99.5 mole-%.

Next, emulsion EMP-1B was prepared in the same manner as in EMP-1A except that the adding time of Solutions A and B and that of Solutions C and D were changed. EMP-1B was a monodisperse cubic emulsion having an average grain diameter of 0.50 μm, a variation coefficient of grain size of 0.07, and a silver chloride content of 99.5 mole-%.

EMP-1A was optimally subjected to a chemical sensitization at 60° C. using the following compounds. EMP-1B was also optimally sensitized in a similar manner. Sensitized EMP-1A and EMP-1B were mixed in a ratio of 1:1 in silver amount to prepare a blue-sensitive silver halide emulsion Em-B1.

| | |
|---|---|
| Sodium thiosulfate | 0.8 mg/mole of AgX |
| Chloroauric acid | 0.5 mg/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |
| Sensitizing dye BS-1 | $4 \times 10^{-4}$ moles/mole of AgX |
| Sensitizing dye BS-2 | $1 \times 10^{-4}$ moles/mole of AgX |

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole (Preparation of Green-sensitive Emulsion Em-G1)

A monodisperse cubic emulsion EMP-11A having an average grain diameter of 0.40 μm, silver chloride content of 99.5 mole-% and a monodisperse cubic emulsion EMP-11B having an average grain diameter of 0.45 μm, silver chloride content of 99.5 mole-% were prepared in the same manner as in the fore going silver halide emulsion EMP-1A except that the adding time of Solutions A and B and that of Solutions C and D were changed.

EMP-11A was optimally subjected to a chemical sensitization at 60° C. using the following compounds. EMP-11B was also optimally sensitized in a similar manner. Sensitized EMP-11A and EMP-11B were mixed in a ratio of 1:1 in silver amount to prepare a green-sensitive silver halide emulsion Em-G1.

| | |
|---|---|
| Sodium thiosulfate | 1.5 mg/mole of AgX |
| Chloroauric acid | 1.0 mg/mole of AgX |
| Sensitizing dye GS-1 | $4 \times 10^{-4}$ moles/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |

(Preparation of Red-sensitive Emulsion Em-R1)

A monodisperse cubic emulsion EMP-21A having an average grain diameter of 0.38 μm, silver chloride content of 99.5 mole-% and a monodisperse cubic emulsion EMP-21B having an average grain diameter of 0.42 μm, silver chloride content of 99.5 mole-% were prepared in the same manner as in the fore going silver halide emulsion EMP-1A except that the addition time of Solutions A and B and that of Solutions C and D were changed.

EMP-21A was optimally subjected to a chemical sensitization at 60° C. using the following compounds. EMP-21B was also optimally sensitized in a similar manner. Sensitized EMP-21A and EMP-21B were mixed in a ratio of 1:1 in silver amount to prepare a red-sensitive silver halide emulsion Em-R1.

| | |
|---|---|
| Sodium thiosulfate | 1.8 mg/mole of AgX |
| Chloroauric acid | 2.0 mg/mole of AgX |
| Sensitizing dye RS-1 | $1 \times 10^{-4}$ moles/mole of AgX |
| Sensitizing dye RS-2 | $1 \times 10^{-4}$ moles/mole of AgX |
| Supersensitizer SS-1 | $2 \times 10^{-3}$ moles/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |

The chemical structure of the additives used in Em-B1, Em-G1 and Em-R1 are listed below.

BS-1

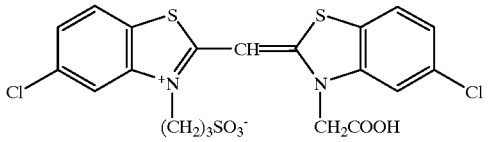

BS-2

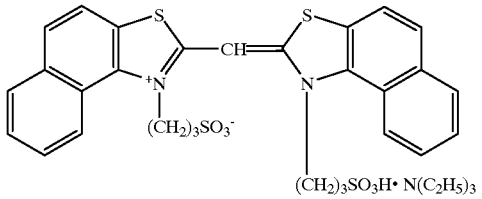

GS-1

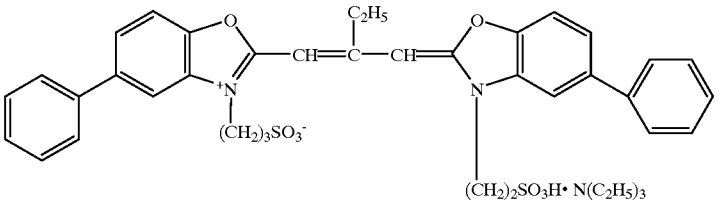

RS-1

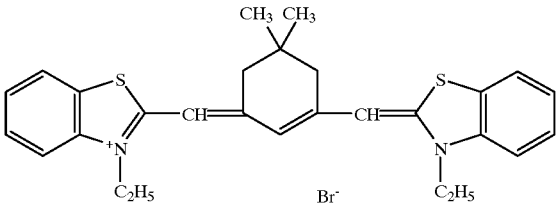

RS-2

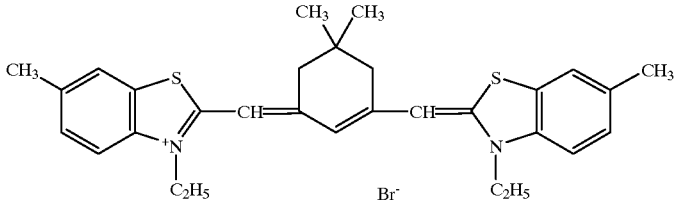

SS-1

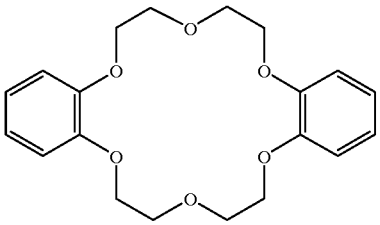

(Preparation of Light-sensitive Materials 101 through 104)

A paper support was prepared by laminating a high density polyethylene on pulp paper having a weight of 180 g/m$^2$. The laminating layer on which the emulsion to be coated-was made by laminating a molten polyethylene in which 15% by weight of anatase type titanium oxide was dispersed. Thus prepared reflective support is subjected to a corona discharge treatment, and a gelatin subbing layer was provided thereon. Moreover the following layers were coated on the support so as to have hwb value shown in Table 2 evaluated by a way mentioned later to prepare a multilayered light-sensitive material 101.

In the preparation of the light-sensitive material, the coating liquids were each prepared so that the coating amount of each of the components was as follows. Hardeners H-1 and H-2 were added to the layers and coating aids SU-1 and SU-2 were added as the coating aids to control the surface tension of each of the coating liquid. An anti-mold agent F-1 was added to each of the layer so that the total mount was 0.04 g/m$^2$. The compositions of the each layer are given below in which the amount of the silver halide emulsion is described in terms of silver.

| Layer | Composition | Coated amount (g/m$^2$) |
|---|---|---|
| 7th layer | (Protective layer) | |
| | Gelatin | 1.00 |
| | High-boiling solvent (DIPD) | 0.002 |
| | High-boiling solvent (DBP) | 0.002 |
| | Silicon dioxide | 0.003 |
| 6th layer | (UV absorbing layer) | |
| | Gelatin | 0.40 |
| | Anti-irradiation dye (AI-1) | 0.01 |
| | UV absorbent (UV-1) | 0.12 |
| | UV absorbent (UV-2) | 0.04 |
| | UV absorbent (UV-3) | 0.16 |
| | Stain preventing agent (HQ-5) | 0.04 |
| | PVP | 0.03 |

-continued

| Layer | Composition | Coated amount (g/m$^2$) |
|---|---|---|
| 5th layer | (Red-sensitive layer) | |
| | Gelatin | 1.30 |
| | Red-sensitive emulsion (Em-R1) | 0.17 |
| | Cyan coupler (C-1) | 0.28 |
| | Dye image stabilizing agent (ST-1) | 0.10 |
| | Stain preventing agent (HQ-1) | 0.004 |
| | High-boiling solvent (DBP) | 0.10 |
| | High-boiling solvent (DOP) | 0.20 |
| 4th layer | (UV absorbing layer) | |
| | Gelatin | 0.94 |
| | UV absorbent (UV-1) | 0.28 |
| | UV absorbent (UV-2 | 0.09 |
| | UV absorbent (UV-3) | 0.38 |
| | Anti-irradiation dye (AI-1) | 0.02 |
| | Stain preventing agent (HQ-5) | 0.10 |
| 3rd layer | (Green-sensitive layer) | |
| | Gelatin | 1.30 |
| | Anti-irradiation (AI-2) | 0.01 |
| | Green-sensitive emulsion (Em-G1) | 0.15 |
| | Magenta coupler (M-1) | 0.20 |
| | Dye image stabilizing agent (ST-3) | 0.20 |
| | Dye image stabilizing agent (ST-4) | 0.17 |
| | High-boiling solvent (DIPD) | 0.13 |
| | High-boiling solvent (DBP) | 0.13 |
| 2nd layer | (Interlayer) | |
| | Gelatin | 1.20 |
| | Anti-irradiation dye (AI-3) | 0.01 |
| | Stain preventing agent (HQ-2) | 0.03 |
| | Stain preventing agent (HQ-3) | 0.03 |
| | Stain preventing agent (HQ-4) | 0.05 |
| | Stain preventing agent (HQ-5) | 0.23 |
| | High-boiling solvent (DIPD) | 0.04 |
| | High-boiling solvent (DBP) | 0.02 |
| | Fluorescent whitening agent (W-1) | 0.10 |

-continued

| Layer | Composition | Coated amount (g/m$^2$) |
|---|---|---|
| 1st layer | (Blue-sensitive layer) | |
| | Gelatin | 1.20 |
| | Blue-sensitive emulsion (Em-B1) | 0.28 |
| | Yellow coupler (Y-1) | 0.70 |
| | Dye image stabilizing agent (ST-1) | 0.10 |
| | Dye image stabilizing agent (ST-2) | 0.10 |
| | Dye image stabilizing agent (ST-5) | 0.10 |
| | Stain preventing agent (HQ-1) | 0.01 |
| | Image stabilizing agent A | 0.15 |
| | High-boiling solvent (DBP) | 0.10 |
| | High-boiling solvent (DNP) | 0.05 |

Support Polyethylene Laminated Paper

The chemical structures of each of the additives used for the preparation of the light-sensitive material are shown below.

SU-1: Sodium tri-i-propylnaphthalenesulfate
SU-2: Sodium salt of di-(2-ethylhexyl) sulfosuccinate
SU-3: Sodium salt of di-(2,2,3,3,4,4,5,5-octafluoropentyl) sulfosuccinate
H-1: Tetrakis(vinylsulfonylmethyl)methane
H-2: Sodium salt of 2,4-dichloro-6-hydroxy-s-triazine
DBP: Dibutyl phthalate
DIDP: Diisodecyl phthalate
DOP: Dioctyl phthalate
DNP: Dinonyl phthalate
PVP: Polyvinylpyrrolidone
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl)-butylhydroquinone
Image stabilizing agent A: p-t-octylphenol

C-1

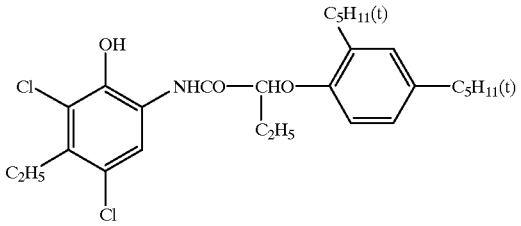

M-1

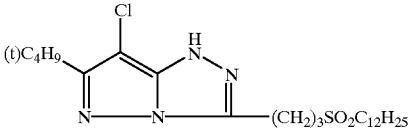

Y-1

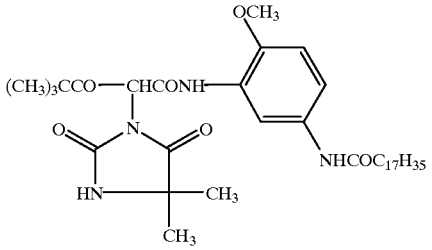

ST-1

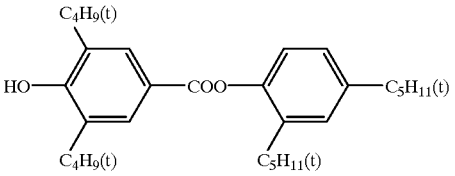

ST-2

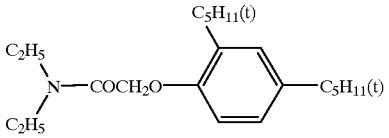

ST-3

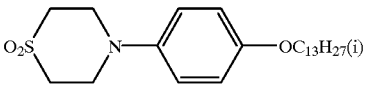

-continued
ST-4
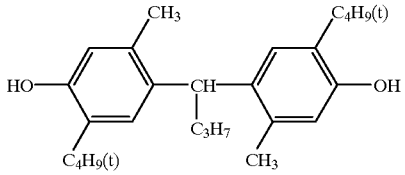
ST-5
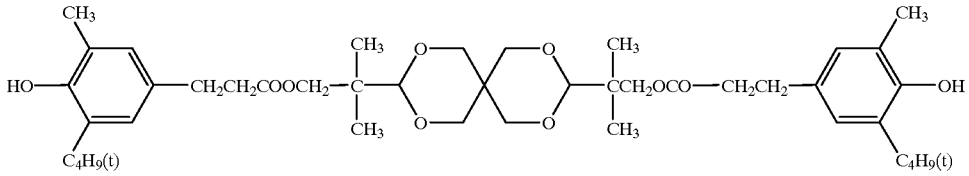
AI-1
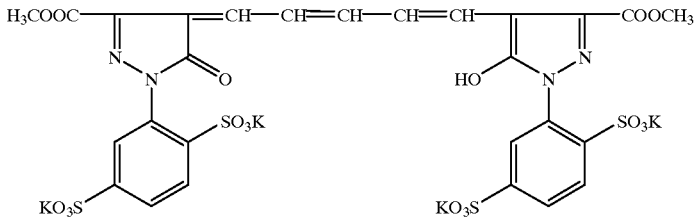
AI-2
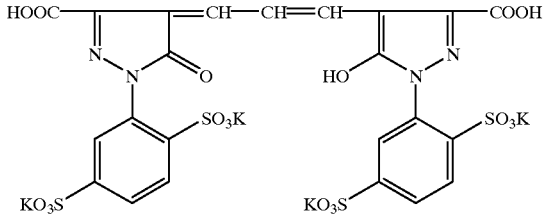
AI-3
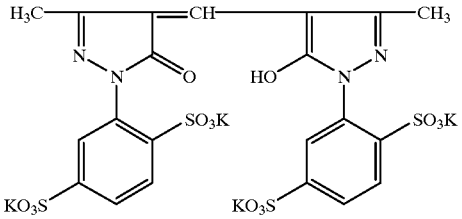
F-1
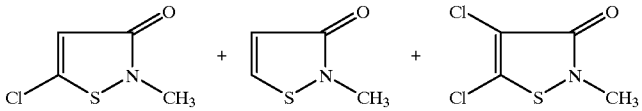
A mixture of the above compounds in a mole ration of 50:46:4
UV-1
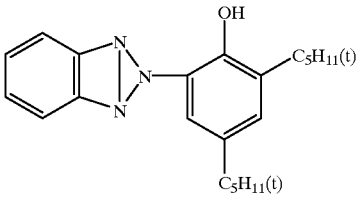
UV-2
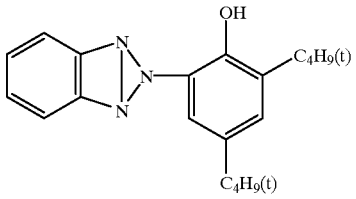
UV-3
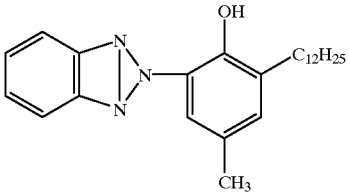

-continued

W-1

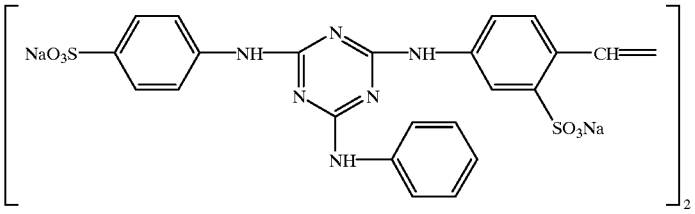

Light-sensitive materials 102 to 104, which have the hwb values shown in Table 2, were prepared in the same manner as in light-sensitive material 101 except that the kind and amount of heavy metal compounds added to Solution A and C were changed to show Table 1.

TABLE 1*

| Photo-sensitive material | | Yellow Metal Complex | Yellow Amount | Magenta Metal Complex | Magenta Amount | Cyan Metal Complex | Cyan Amount |
|---|---|---|---|---|---|---|---|
| 101 | A | — | — | — | — | — | — |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |
| 102 | A | $K_2[IrCl_6]$ | $1.5 \times 10^{-8}$ | $K_2[IrCl_6]$ | $1.5 \times 10^{-8}$ | $K_2[IrCl_6]$ | $1.5 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |
| 103 | A | $K_3[RhCl_6]$ | $1.5 \times 10^{-8}$ | $K_3[RhCl_6]$ | $6 \times 10^{-8}$ | $K_2[RhCl_6]$ | $8 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_2[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |
| 104 | A | $K_3[RhCl_6]$ | $0.5 \times 10^{-8}$ | $K_3[RhCl_6]$ | $0.5 \times 10^{-8}$ | — | — |
| | C | $K_2[IrCl_6]$ | $4 \times 10^{-8}$ | $K_2[IrCl_6]$ | $4 \times 10^{-8}$ | $K_2[IrCl_6]$ | $2 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |

Thus prepared light-sensitive material 101 through 104 were each subjected to the following scanning exposure and processing.

The light source of the scanning exposure was a semiconductor laser emitting light of 650 nm, a He—Ne gas laser emitting light of 544 nm and an Ar gas laser emitting light of 458 nm. The scanning was performed by reflecting by a polygon mirror the light beams each emitted from the lasers for main scanning while the light intensity was modulated by an AOM and transporting the light-sensitive material is transported in the direction being at right angles with the main scanning direction for sub-scanning. The diameter of the light beam was adjusted to 126 $\mu$m and the sub-scanning pitch was controlled so that the pixel size r in $\mu$m was adjusted to that described in Table 2. The maximum exposing amount was adjusted by calibrating employing gray wedge image having 22 step so that the optimal image could be obtained. Using the apparatus, image data of one pixel width fine line of (R,G,B)=(0, 0, 0) prepared by Photoshop 5.0 so as to be fitted with the resolving power of the exposure was output to the light-sensitive material. Then the light-sensitive material was processed by the following Processing 1.

The density profile of thus obtained image of the one pixel width fine line was measured by scanning by Microdensitometer PDM-5AR, manufactured by Konica Corp., in the direction being at right angles with the main scanning direction. The total magnitude of the microdensitometry was 50 times, the aperture sized was 400×4 $\mu$m and the scanning interval was 4 $\mu$m. The region of 5 mm was scanned. Thus the half band width, hwb in $\mu$m, was determined. The result is summarized in Table 2.

(Processing 1)

| Process | Temperature | Time |
|---|---|---|
| Color development CD-1 | 37.0 ± 0.5° C. | 45 seconds |
| Bleach-fixing BF-1 | 35.0 ± 2.5° C. | 45 seconds |
| Stabilizing | 35 – 39° C. | 45 seconds |
| Drying | 60 – 80° C. | 30 seconds |

Color developing solution CD-1

| | |
|---|---|
| Purified water | 800 ml |
| Triethylenediamine | 2 g |
| Diethylene glycol | 10 g |
| Potassium bromide | 0.02 g |
| Potassium chloride | 4.5 g |
| Potassium sulfite | 0.25 g |
| N-ethyl-N-(β-methanesulfonamidoethyl)-3-methyl-4-aminoaniline sulfate | 4.0 g |
| N,N-dihydroxylamine | 5.6 g |
| Triethanolamine | 10.0 g |
| Sodium diethylenetriaminepentaacetate | 2.0 g |
| Potassium carbonate | 30 g |
| Water to make | 1 l |

Adjust pH to 10.1 using sulfuric acid or potassium hydroxide.

-continued

| Bleach-fixing solution (BF-1) | |
|---|---|
| Purified water | 700 ml |
| Ferric ammonium diethylenetriamine-pentaacetate dihydrate | 65 g |
| Diethylenetriaminepentaacetic acid | 3 g |
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |
| Water to make | 1 l |
| Adjust pH to 5.0 using potassium carbonate or glacial acetic acid. | |
| **Stabilizing solution** | |
| Purified water | 800 ml |
| o-phenylphenol | 1.0 g |
| 5-chloro-2-methyl-4-isothiazoline-3-one | 0.02 g |
| 2-methyl-4-isothiazoline-3-one | 0.02 g |
| diethylene glycol | 1.0 g |
| Fluorescent whitening agent (Cinopal SFP) | 2.0 g |
| 1-hydroxyethylidene-1,1-disulfonic acid | 1.8 g |
| Magnesium sulfate heptahydrate | 0.2 g |
| Polyvinylpyrrolidone | 1.0 g |
| Trisodium nitrilotriacetate | 1.5 g |
| Water to make | 1 l |
| Adjust pH to 7.5 using sulfuric acid or potassium hydroxide. | |

TABLE 2

| Photosensitive Material | Pixel Size | Yellow Layer hwb | Yellow Layer hwb − r | Magenta Layer hwb | Magenta Layer hwb − r | Cyan Layer hwb | Cyan Layer hwb − r | Remarks |
|---|---|---|---|---|---|---|---|---|
| 101 | 85 | 127 | 42 | 143 | 58 | 122 | 37 | Comparative |
| | 101 | 146 | 45 | 159 | 58 | 139 | 38 | |
| | 113 | 150 | 37 | 168 | 55 | 146 | 33 | |
| 102 | 85 | 121 | 36 | 125 | 40 | 122 | 37 | Invention |
| | 101 | 135 | 34 | 142 | 41 | 137 | 36 | |
| | 113 | 152 | 39 | 158 | 45 | 153 | 40 | |
| 103 | 85 | 121 | 36 | 119 | 34 | 112 | 27 | Invention |
| | 101 | 135 | 34 | 134 | 33 | 130 | 29 | |
| | 113 | 152 | 39 | 150 | 37 | 144 | 31 | |
| 104 | 85 | 118 | 33 | 132 | 47 | 129 | 44 | Invention |
| | 101 | 131 | 30 | 148 | 47 | 148 | 47 | |
| | 113 | 144 | 31 | 160 | 47 | 155 | 42 | |

Employing samples 101 to 104 thus prepared, an image including a text of 2-point and 4-point characters each written by a three kinds of black, (B,G,R)=(0, 0, 0), (13, 13, 13) and (26, 26, 26), and a solid image of 50% gray was output. The diameter of the light beam was adjusted to 85 $\mu$m by controlling the sub-scanning pitch and the maximum exposing amount was adjusted by calibration so that the optimal image could be obtained at each of the setting of the apparatus. Further, the pixel size r in $\mu$m was modified to be 101 and 113 $\mu$m by changing sub-scanning pitches, and the images were output in the similar way.

Thus prepared printed image are evaluated by 20 observers. The evaluation was performed regarding the reproducibility of character (blackness of the image, sharpness of edge, color discrepancy at the outline of the character and the density rising at the fine white portion), and the uniformity of the solid image (formation of the scanning noise line and roughness feeling of image). Evaluation result is expressed by points (the maximum point was 100). A higher average value of the points marked by the 20 observers represents a enhanced effects of the invention that the print was excellent in the reproducibility of black character image, was inhibited in the ununiformity of the scanning and a beautiful print could be obtained independently on the change of the exposure resolving power or the change of the exposure apparatus. The results are shown Table 3.

TABLE 3

| Photo-sensitive Material | Run | Pixel Size | Layer giving minimum hwb | $hwb_{max}/hwb_{min}$ | Image Quality | Re-marks |
|---|---|---|---|---|---|---|
| 101 | 101 | 85 | Cyan | 1.17 | 55 | Comp. |
| | 102 | 101 | Cyan | 1.14 | 41 | |
| | 103 | 113 | Cyan | 1.15 | 27 | |
| 102 | 104 | 85 | Yellow | 1.03 | 98 | Inv. |
| | 105 | 101 | Yellow | 1.05 | 91 | |
| | 106 | 113 | Yellow | 1.04 | 86 | |
| 103 | 107 | 85 | Cyan | 1.08 | 80 | Inv. |
| | 108 | 101 | Cyan | 1.04 | 78 | |
| | 109 | 113 | Cyan | 1.06 | 75 | |
| 104 | 110 | 85 | Yellow | 1.12 | 81 | Inv. |
| | 111 | 101 | Yellow | 1.13 | 77 | |
| | 112 | 113 | Yellow | 1.11 | 78 | |

The results in Table 3 show that the ranks of the quality evaluation of the images obtained by runs 101 to 103 stay at a low level hence a magenta colored blur is formed at the edge of the character and the character image is expanded so as to fall the reproducibility of the fine structure of the character, even though the scanning noise line and the ununiformity are almost not observed in the solid image area of 50% gray in Sample 101. The prints obtained by the photographic material samples 102 to 104 satisfying the requirements of the invention each get a high evaluation points since the edge of the black character is sharp, and the scanning noise line and the ununiformity in the solid image area of 50% gray are almost not observed and it is understood that these are preferable image forming method. Photographic material sample 102 among these satisfies the preferable stipulation that hwb value is minimum in the yellow layer does not show blur image at the black character edges. Further, the photographic material sample 102, satisfying the preferable condition according to the invention that $hwb_{max}/hwb_{min}$ falls within 1.0 to 1.1, was highly evaluated since neutrality was well maintained in color balance of edge part of black character. It is understood that the condition is the particularly preferable embodiment.

Example 2

(Preparation of Light-sensitive Materials 201 and 202)

Multilayered Light-sensitive materials 201 and 202 were prepared in the same manner as in Light-sensitive material 101 except that the kind and the amount of heavy metal complex to be added to Solution A or C to be used for forming the silver halide grains were changed as shown in Table 4. The light sensitive materials each had the hwb and fwb values as shown in Table 5 when the light sensitive materials were evaluated according to the later-mentioned procedure.

TABLE 4

| Photo-sensitive material | | Yellow Metal Complex | Yellow Amount | Magenta Metal Complex | Magenta Amount | Cyan Metal Complex | Cyan Amount |
|---|---|---|---|---|---|---|---|
| 201 | A | — | — | $K_3[RhBr_6]$ | $1.5 \times 10^{-8}$ | $K_3[RhBr_6]$ | $1.5 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |
| 202 | A | $K_3[RhBr_6]$ | $4 \times 10^{-8}$ | $K_3[RhBr_6]$ | $4 \times 10^{-8}$ | $K_3[RhBr_6]$ | $4 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |

TABLE 5

| Photosensitive Material | Pixel Size | Yellow Layer hwb | Yellow Layer hwb − r | Yellow Layer fwb | Magenta Layer hwb | Magenta Layer hwb − r | Magenta Layer fwb | Cyan Layer hwb | Cyan Layer hwb − r | Cyan Layer fwb | Remarks |
|---|---|---|---|---|---|---|---|---|---|---|---|
| 101 | 85 | 127 | 42 | 454 | 143 | 58 | 376 | 122 | 37 | 436 | Comp. |
| | 101 | 146 | 45 | 521 | 159 | 58 | 568 | 139 | 38 | 366 | |
| | 113 | 150 | 37 | 395 | 168 | 55 | 600 | 146 | 33 | 384 | |
| 102 | 85 | 121 | 36 | 336 | 125 | 40 | 391 | 122 | 37 | 321 | Inv. |
| | 101 | 135 | 34 | 365 | 142 | 41 | 418 | 137 | 36 | 361 | |
| | 113 | 152 | 39 | 411 | 158 | 45 | 439 | 153 | 40 | 403 | |
| 201 | 85 | 121 | 36 | 432 | 124 | 39 | 376 | 122 | 37 | 330 | Inv. |
| | 101 | 135 | 34 | 482 | 141 | 40 | 403 | 138 | 37 | 363 | |
| | 113 | 152 | 39 | 400 | 153 | 40 | 450 | 154 | 41 | 405 | |
| 202 | 85 | 118 | 33 | 295 | 120 | 35 | 308 | 114 | 29 | 285 | Inv. |
| | 101 | 131 | 30 | 320 | 132 | 31 | 330 | 132 | 31 | 307 | |
| | 113 | 145 | 32 | 354 | 148 | 35 | 361 | 146 | 33 | 348 | |

The hwb and fwb values of thus prepared Light-sensitive materials 201 and 202, and the fwb values of Light-sensitive materials of 101 and 102 prepared in Example 1 were determined by the following procedure using the exposing apparatus the same as that used in Example 1.

An image including a text of 2-point and 4-point characters each written by 3 levels of black, (R,G,B)=(0, 0, 0), (13, 13, 13) and (26, 26, 26) and a solid area of 50% gray was output to thus prepared Light-sensitive material 201 and 202 and Light-sensitive materials 101 and 102.

Thus printed image are evaluated by 20 observers. The evaluation was performed regarding the reproducibility of character (blackness of the image, sharpness of edge, color discrepancy at the outline of the character and the density rising at the fine white portion), and the uniformity of the solid image (formation of the scanning noise line and roughness feeling of image). Evaluation result is expressed by points (the maximum point was 100). A higher average value of the evaluation points marked by the 20 observers represents a enhanced effects of the invention that the print was excellent in the reproducibility of black character image, was inhibited in the ununiformity of the scanning and a beautiful print could be obtained independently on the change of the exposure resolving power or the change of the exposure apparatus. The results are shown in Table 6.

TABLE 6

| Photo-sensitive Material | Run | Pixel Size | hwb/fwb Yellow Layer | hwb/fwb Magenta Layer | hwb/fwb Cyan Layer | Image Quality | Re-marks |
|---|---|---|---|---|---|---|---|
| 101 | 201 | 85 | 0.28 | 0.38 | 0.28 | 55 | Comp. |
| | 202 | 101 | 0.28 | 0.28 | 0.38 | 41 | |
| | 203 | 113 | 0.38 | 0.28 | 0.38 | 27 | |
| 102 | 204 | 85 | 0.36 | 0.32 | 0.38 | 98 | Inv. |
| | 205 | 101 | 0.37 | 0.34 | 0.38 | 91 | |
| | 206 | 113 | 0.37 | 0.36 | 0.38 | 86 | |

TABLE 6-continued

| Photo-sensitive Material | Run | Pixel Size | hwb/fwb Yellow Layer | hwb/fwb Magenta Layer | hwb/fwb Cyan Layer | Image Quality | Re-marks |
|---|---|---|---|---|---|---|---|
| 201 | 207 | 85 | 0.28 | 0.33 | 0.37 | 78 | Inv. |
| | 208 | 101 | 0.28 | 0.35 | 0.38 | 76 | |
| | 209 | 113 | 0.38 | 0.34 | 0.38 | 80 | |
| 202 | 210 | 85 | 0.40 | 0.39 | 0.40 | 81 | Inv. |
| | 211 | 101 | 0.41 | 0.40 | 0.43 | 76 | |
| | 212 | 113 | 0.41 | 0.41 | 0.42 | 77 | |

The results of Table 6 show that in Light-sensitive materials 102, 201 and 202 satisfying the requirements of the invention each get a high evaluation point since the edge of the black character is sharply reproduced, and the scanning noise line and the ununiformity in the solid image area of 50% gray are almost not observed. Particularly, the black characters are reproduced with a very high sharpness in Light-sensitive material 102 which satisfies the preferable condition of the invention that the hwb/fwb value in each of color image-forming layers are within the range of from 0.3 to 0.4. It is understood, therefore, that such the embodiment is specifically preferable.

Example 3

(Preparation of Light-sensitive Material 301)

Multilayered Light-sensitive material 301 was prepared in the same manner as in Light-sensitive material 101 except that the kind and the amount of the heavy metal complex to be added to Solution A or C to be used for forming the silver halide grains were changed as shown in Table 7. The light sensitive materials each had the hwb and hww values as shown in Table 8 when the light sensitive materials were evaluated according to the later-mentioned procedure.

TABLE 7

| Photo-sensitive material | | Yellow Metal Complex | Yellow Amount | Magenta Metal Complex | Magenta Amount | Cyan Metal Complex | Cyan Amount |
|---|---|---|---|---|---|---|---|
| 201 | A | $K_3[RhBr_6]$ | $0.5 \times 10^{-8}$ | $K_3[RhBr_6]$ | $0.5 \times 10^{-8}$ | $K_3[RhBr_6]$ | $0.5 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $2 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |

The hwb value of thus prepared Light-sensitive material 301 was determined in the same manner as in Example 1, and hww values of Light sensitive material 301 and Light-sensitive materials 101 through 103 prepared in Example 1 were determined according to the followings using the exposing apparatus the same as in Example 1.

The light beam diameter was adjusted to 126 μm and the sub-scanning speed was controlled so that the pixel size r (μm) was adjusted to that described in Table 8. The maximum output was adjusted so that the optimal image could be obtained. Using the apparatus, image data of a solid image of (R,G,B)=(0, 0, 0) of a size of 6 cm×6 cm having a fine white line, (R,G,B)=(255, 255, 255), of one pixel width at the center thereof were output to the light-sensitive material. The image data were prepared by Photoshop 5.0 so as to be fitted with the resolving power of the exposure. Then the light-sensitive material was processed by the following Processing 1. Thus obtained image of the fine white line was subjected to measurement by the microdensitometer in the same manner as in Example 1 to determined the half band width hww in μm of the white line.

TABLE 8

| Photo-Sensitive Material | Pixel Size | Yellow Layer hwb | hwb – r | hww | hww – r | Magenta Layer hwb | hwb – r | hww | hww – r | Cyan Layer hwb | hwb – r | hww | hww – r | Remarks |
|---|---|---|---|---|---|---|---|---|---|---|---|---|---|---|
| 301 | 85 | 120 | 35 | 98 | 13 | 134 | 49 | 109 | 24 | 120 | 35 | 110 | 25 | Inv. |
| | 101 | 138 | 37 | 114 | 13 | 150 | 49 | 119 | 18 | 137 | 36 | 127 | 26 | |
| | 113 | 147 | 34 | 127 | 14 | 162 | 49 | 136 | 23 | 144 | 31 | 142 | 29 | |
| 101 | 85 | 127 | 42 | 93 | 8 | 143 | 58 | 85 | 0 | 122 | 37 | 95 | 10 | Com. |
| | 101 | 146 | 45 | 113 | 12 | 159 | 58 | 104 | 3 | 139 | 38 | 115 | 14 | |
| | 113 | 150 | 37 | 126 | 13 | 168 | 55 | 121 | 8 | 146 | 33 | 134 | 21 | |
| 102 | 85 | 121 | 36 | 135 | 50 | 125 | 40 | 134 | 49 | 122 | 37 | 134 | 49 | Inv. |
| | 101 | 135 | 34 | 153 | 52 | 142 | 41 | 148 | 47 | 137 | 36 | 146 | 45 | |
| | 113 | 152 | 39 | 166 | 53 | 158 | 45 | 164 | 51 | 153 | 40 | 156 | 43 | |
| 103 | 85 | 121 | 36 | 135 | 50 | 119 | 34 | 140 | 55 | 112 | 27 | 144 | 59 | Inv. |
| | 101 | 135 | 34 | 153 | 52 | 134 | 33 | 152 | 51 | 130 | 29 | 158 | 57 | |
| | 113 | 152 | 39 | 166 | 53 | 150 | 37 | 168 | 55 | 144 | 31 | 170 | 57 | |

In the exposing apparatus, the transport pitch in the sub-scanning direction was controlled so that the pixel size r was adjusted to 85 μm and the image output was set by a calibration operation so as to output the optimum image. An image including a text of white 2-point and 4-point characters, a text of 2-point and 4-point characters each written by 3 levels of black, (R,G,B)=(0, 0, 0), (13, 13, 13) and (26, 26, 26) and a solid image area of 50% gray was output by such the apparatus at each of the setting to thus prepared Light-sensitive material 301 and Light-sensitive materials 101 to 103 prepared in Example 1. Moreover, the same image was output in the same manner as above except that the pixel size was changed to 101 and 113 μm.

Thus obtained printed images were evaluated by 20 observers. The evaluation was performed regarding the reproducibility of character (whiteness of the image and sharpness of edge, color discrepancy at the outline of the character), and the uniformity of the solid image (formation of the scanning noise line and roughness feeling of image). Evaluation result was expressed by points (the maximum point was 100). A higher average value of the points marked by the 20 observers represents a enhanced effects of the invention that the print was excellent in the reproducibility of white character image and inhibited in the ununiformity of the scanning, and a beautiful print could be obtained independently on the change of the exposure resolving power or the change of the exposure apparatus. The results are shown in Table 9.

TABLE 9

| Photo-sensitive Material | Run | Pixel Size | Layer giving maximum hww | $hww_{max}/hww_{min}$ | Image Quality | Remarks |
|---|---|---|---|---|---|---|
| 301 | 301 | 85 | Cyan | 1.12 | 73 | Inv. |
| | 302 | 101 | Cyan | 1.11 | 71 | |
| | 303 | 113 | Cyan | 1.12 | 70 | |

TABLE 9-continued

| Photo-sensitive Material | Run | Pixel Size | Layer giving maximum hww | $hww_{max}/hww_{min}$ | Image Quality | Remarks |
|---|---|---|---|---|---|---|
| 101 | 304 | 85 | Cyan | 1.12 | 52 | Comp. |
| | 305 | 101 | Cyan | 1.11 | 47 | |
| | 306 | 143 | Cyan | 1.11 | 31 | |
| 102 | 307 | 85 | Yellow | 1.01 | 97 | Inv. |
| | 308 | 101 | Yellow | 1.05 | 98 | |
| | 309 | 113 | Yellow | 1.06 | 92 | |
| 103 | 310 | 85 | Cyan | 1.07 | 81 | Inv. |
| | 311 | 101 | Cyan | 1.04 | 78 | |
| | 312 | 113 | Cyan | 1.02 | 76 | |

The results in Table 9 show that the ranks of the quality evaluation of the images obtained by light sensitive material 101 are stayed at a low level hence the edge of the white character is eroded so as to lower the reproducibility of the fine structure of the character, even though the canning line an the ununiformity are almost not observed in the 50% gray image area. On the other hand, The prints obtained by Light-sensitive materials 301 and 102 to 103 satisfying the requirements of the invention each get a high evaluation points since the edge of the white character is sharply reproduced, and the scanning noise line and the ununiformity in the solid image area of 50% gray are almost not observed. It is understood that these light-sensitive materials are preferable. Among them, Light-sensitive materials 102 and 103 satisfying the preferable requirement of the invention that the ratio of $hww_{max}/hww_{min}$ is from 1.0 to 1.1 each get a very high evaluation points hence the color balance at the edge of the white character has a right neutrality. Furthermore, Light-sensitive material 102 satisfying the preferable requirement of the invention that the hww value of the yellow dye-forming layer is largest. In this light-sensitive material, the reproducibility of the black character is excellent and the blur of yellow component at the edge of the white character almost not observed through Runs 307 to 309. It is understood, therefore, Light-sensitive material is particularly preferable embodiment 102 of the invention.

Example 4

(Preparation of Light-sensitive Materials 401 and 402)

Multilayered Light-sensitive materials 401 and 402 were prepared in the same manner as in Light-sensitive material 101 except that the kind and the amount of heavy metal complex to be added to Solution A or C to be used for forming the silver halide grains were changed as shown in Table 10. The light sensitive materials each had the hwb and fww values as shown in Table 11 when the light sensitive materials were evaluated according to the later-mentioned procedure.

The hwb value and the hww value of Light-sensitive materials 401 and 402 were each determined in the same manner as in Example 1 and Example 3, respectively. Moreover, The fww values of Light-sensitive materials 401 and 402 and Light-sensitive materials 101 and 102 prepared in Example 1 were determined by the following procedure using the exposing apparatus the same as that in Example 1.

The light beam diameter was adjusted to 126 μm and the sub-scanning speed was controlled so that the pixel size r in μm was adjusted to that described in Table 12. The maximum exposure amount was adjusted so that the optimal image could be obtained. Using the apparatus, image data of a solid image of (R,G,B)=(0, 0, 0) of a size of 6 cm×6 cm having a fine white line of one pixel width, (R,G,B)=(255, 255, 255) at the center thereof were output to each of the light-sensitive materials. The image data were prepared by Photoshop 5.0 so as to be fitted with the resolving power of the exposure. Then the light-sensitive material was processed by the following Processing 1. Thus obtained white fine line image was measured by the microdensitometer in the same manner as in Example 1 to determine the half band width of the white line hww in μm and the width at the legs of the density profile of the white line fww in μm.

TABLE 10

| Photo- | | Yellow | | Magenta | | Cyan | |
|---|---|---|---|---|---|---|---|
| sensitive material | | Metal Complex | Amount | Metal Complex | Amount | Metal Complex | Amount |
| 401 | A | — | — | $K_3[RhBr_6]$ | $1.5 \times 10^{-8}$ | $K_3[RBr_6]$ | $1.5 \times 10^{-8}$ |
| | C | $K_2[IrCl_6]$ | $4 \times 10^{-8}$ | $K_2[IrCl_6]$ | $3 \times 10^{-8}$ | $K_2[IrCl_6]$ | $3 \times 10^{-8}$ |
| | | $K_4[Fe(CN)_6]$ | $2 \times 10^{-5}$ | $K_4[Fe(CN)_6]$ | $1.5 \times 10^{-5}$ | $K_4[Fe(CN)_6]$ | $1.5 \times 10^{-5}$ |
| 402 | A | $K_3[RhBr_6]$ | $3 \times 10^{-8}$ | $K_3[RhBr_6]$ | $3 \times 10^{-8}$ | $K_3[RhBr_6]$ | $3 \times 10^{-8}$ |
| | C | $K_2[IrCl_6]$ | $4 \times 10^{-8}$ | $K_2[IrCl_6]$ | $4 \times 10^{-8}$ | $K_2[IrCl_6]$ | $4 \times 10^{-8}$ |
| | | $K_4[Fe(CN)_6]$ | $2 \times 10^{-5}$ | $K_4[Fe(CN)_6]$ | $2 \times 10^{-5}$ | $K_4[Fe(CN)_6]$ | $2 \times 10^{-5}$ |

TABLE 11

| Photo- | | Yellow Layer | | | | Magenta Layer | | | | Cyan Layer | | | | |
|---|---|---|---|---|---|---|---|---|---|---|---|---|---|---|
| Sensitive Material | Pixel Size | hwb | hwb − r | hww | fww | hwb | hwb − r | hww | fww | hwb | hwb − r | hww | fww | Remarks |
| 101 | 85 | 127 | 42 | 93 | 332 | 143 | 58 | 85 | 304 | 122 | 37 | 95 | 328 | Comp. |
| | 101 | 146 | 45 | 113 | 390 | 159 | 58 | 104 | 359 | 139 | 38 | 115 | 397 | |
| | 113 | 150 | 37 | 126 | 434 | 168 | 55 | 121 | 432 | 146 | 33 | 134 | 447 | |
| 102 | 85 | 121 | 36 | 135 | 422 | 125 | 40 | 134 | 419 | 122 | 37 | 134 | 419 | Inv. |
| | 101 | 135 | 34 | 153 | 478 | 142 | 41 | 148 | 477 | 137 | 36 | 146 | 471 | |
| | 113 | 152 | 39 | 166 | 519 | 158 | 45 | 164 | 513 | 153 | 40 | 156 | 503 | |
| 401 | 85 | 127 | 42 | 133 | 475 | 126 | 41 | 132 | 426 | 125 | 40 | 131 | 423 | Inv. |
| | 101 | 146 | 45 | 150 | 517 | 144 | 43 | 146 | 471 | 142 | 41 | 143 | 447 | |
| | 113 | 150 | 37 | 163 | 562 | 156 | 43 | 161 | 519 | 158 | 45 | 154 | 497 | |

TABLE 11-continued

| Photo- | | Yellow Layer | | | | Magenta Layer | | | | Cyan Layer | | | | |
|---|---|---|---|---|---|---|---|---|---|---|---|---|---|---|
| Sensitive Material | Pixel Size | hwb | hwb − r | hww | fww | hwb | hwb − r | hww | fww | hwb | hwb − r | hww | fww | Remarks |
| 402 | 85 | 121 | 36 | 129 | 403 | 120 | 35 | 138 | 394 | 114 | 29 | 138 | 337 | Inv. |
| | 101 | 131 | 30 | 147 | 474 | 132 | 31 | 150 | 441 | 132 | 31 | 149 | 355 | |
| | 113 | 145 | 32 | 160 | 516 | 148 | 35 | 166 | 461 | 146 | 33 | 160 | 390 | |

The image including a text of white 2-point and 4-point characters, a text of 2-point and 4-point characters each written by 3 levels of black, (R,G,B)=(0, 0, 0), (13, 13, 13) and (26, 26, 26) and a solid image area of 50% gray was output to Light-sensitive materials 401 and 402 and Light-sensitive materials 101 and 102 prepared in Example 1.

Thus printed images were evaluated by 20 observers. The evaluation was performed regarding the reproducibility of character (whiteness of the image, sharpness of edge and color discrepancy at the outline of the character), and the uniformity of the solid image (formation of the scanning noise line and roughness feeling of image). Evaluation result was expressed by evaluation points (the maximum point was 100). A higher average value of the points marked by the 20 observers represents a enhanced effects of the invention that the print was excellent in the reproducibility of white character image and inhibited in the ununiformity of the scanning, and a beautiful print could be obtained independently on the change of the exposure resolving power or the change of the exposure apparatus. The results are shown in Table 12.

TABLE 12

| Photo- | | | hww/fww | | | | |
|---|---|---|---|---|---|---|---|
| sensitive Material | Run | Pixel Size | Yellow Layer | Magenta Layer | Cyan Layer | Image Quality | Remarks |
| 101 | 401 | 85 | 0.28 | 0.28 | 0.29 | 52 | Comp. |
| | 402 | 101 | 0.29 | 0.29 | 0.29 | 47 | |
| | 403 | 113 | 0.29 | 0.28 | 0.30 | 31 | |
| 102 | 404 | 85 | 0.32 | 0.32 | 0.32 | 95 | Inv. |
| | 405 | 101 | 0.32 | 0.31 | 0.31 | 96 | |
| | 406 | 113 | 0.32 | 0.32 | 0.31 | 87 | |
| 401 | 407 | 85 | 0.28 | 0.31 | 0.31 | 77 | Inv. |
| | 408 | 101 | 0.29 | 0.31 | 0.32 | 75 | |
| | 409 | 113 | 0.29 | 0.31 | 0.31 | 77 | |
| 402 | 410 | 85 | 0.32 | 0.35 | 0.41 | 80 | Inv. |
| | 411 | 101 | 0.31 | 0.34 | 0.42 | 76 | |
| | 412 | 113 | 0.31 | 0.36 | 0.41 | 78 | |

The results in Table 12 show that Light-sensitive materials 102, 401 and 402 according to the invention each get a high evaluation point hence the edge of the white character is sharp and the canning line and ununiformity are almost not observed. It is understood that these light-sensitive materials are preferable. Particularly, both of the clarity of the white character and sharpness of the edge of the black character are excellently reproduced in Light-sensitive material 102 which satisfies the preferable condition of the invention that the hww/fww value of each of the image-forming layer is within the range of from 0.3 to 0.4. It is understood that this light-sensitive material is preferable embodiment of the invention.

Example 5

(Preparation of Light-sensitive Materials 501 and 502)

Multilayered were prepared in the same manner as in Light-sensitive material 101 in Example 1 except that the amount of the stabilizer in the silver halide emulsions each to be use in the 1st, 2nd and 3rd layers was changed as shown in Table 13. The light-sensitive materials each gave the hwb value, $\gamma_a/\gamma_d$ value and $\gamma_x/\gamma_d$ shown in Table 14 when the light-sensitive materials were subjected to the image evaluation by the following procedure.

TABLE 13

| Photo- | Stabilizer and its amount | | | |
|---|---|---|---|---|
| Sensitive Material | Compound | First layer | Second layer | Third layer |
| 101 | STAB-1 | $3 \times 10^{-4}$ | $3 \times 10^{-4}$ | $3 \times 10^{-4}$ |
| | STAB-2 | $3 \times 10^{-4}$ | $3 \times 10^{-4}$ | $3 \times 10^{-4}$ |
| | STAB-3 | $3 \times 10^{-4}$ | $3 \times 10^{-4}$ | $3 \times 10^{-4}$ |
| 501 | STAB-1 | $3 \times 10^{-4}$ | $3 \times 10^{-4}$ | $3 \times 10^{-4}$ |
| | STAB-2 | $7 \times 10^{-4}$ | $7 \times 10^{-5}$ | $7 \times 10^{-5}$ |
| | STAB-3 | $3 \times 10^{-4}$ | $3 \times 10^{-4}$ | $3 \times 10^{-4}$ |
| 502 | STAB-1 | $3 \times 10^{-4}$ | $3 \times 10^{-4}$ | $3 \times 10^{-4}$ |
| | STAB-2 | $7 \times 10^{-5}$ | $7 \times 10^{-5}$ | $7 \times 10^{-5}$ |
| | STAB-3 | $7 \times 10^{-5}$ | $7 \times 10^{-5}$ | $7 \times 10^{-5}$ |

The $\gamma_a$, $\gamma_d$ and $\gamma_x$ of Light-sensitive materials 501 and 502 and 102 prepared in Example 1 were determined as follows.

(Determination of $\gamma_a$)

The light-sensitive materials were one shot exposed to one-shot of red-, green- or blue light through an optical wedge and a color filter, Kodak Wratten Filter No. 29, No. 99 or 47B. The exposing apparatus had a light source of a tungsten lamp and an electronic shutter controlled so that the exposing time was adjusted to 0.5 seconds. Then the light-sensitive materials were subjected to the color developing treatment according to the foregoing Processing 1.

The reflective density of each of the steps formed on each of the light-sensitive material was measured by a spectral colorimeter/densitometer X-Rite 938, manufactured by X-Rite Co., Ltd. The reflective density measured by red-light was plotted with respect to the red-light exposure amount, the reflective density measured by green-light was plotted with respect to the green-light exposure amount and the reflective density measured by blue-light was plotted with respect to the blue-light exposure amount to prepare the characteristic curves. Then the gradient $\gamma_a$ of the density with respect to the exposure amount between a density of 1.0 and a density of 1.5 was determined for each of the yellow, magenta and cyan images.

(Determination of $\gamma_d$)

Test patches of yellow, magenta and cyan images each having a different density varied from the minimum density to the maximum density were output on the light-sensitive material by varying the exposure amount of the blue-, green- or red-light using the exposure apparatus the same as in Example 1. The reflective density of each of thus obtained test patches were measured by the foregoing method and the gradient $\gamma_d$ of the density with respect to the exposure amount between a density of 1.0 and a density of 1.5 was determined for each of the yellow, magenta and cyan images.

(Determination of $\gamma_x$)

The light-sensitive materials were each exposed to one flash of red-, green- or blue-light through optical wedge by the combination of Xe flash light source controlled so that the exposure time was $10^{-6}$ seconds and a color filter, one of Kodak Wratten filter No. 29, No. 99 and No. 47B. Then the light-sensitive material was processed according to Processing 1.

The reflective density of each of the steps formed on each of the light-sensitive material was measured by a spectral colorimeter/densitometer X-Rite 938, manufactured by X-Rite Co., Ltd. The reflective density measured by red-light was plotted with respect to the red-light exposure amount, the reflective density measured by green-light was plotted with respect to the green-light exposure amount and the reflective density measured by blue-light was plotted with respect to the blue-light exposure amount to each prepare the characteristic curves. Then the gradient $\gamma_x$ of the density with respect to the exposure amount between a density of 1.0 and a density of 1.5 was determined for each of the yellow, magenta and cyan images.

TABLE 14

| Photo- | | Yellow Layer | | | | Magenta Layer | | | | Cyan Layer | | | | |
|---|---|---|---|---|---|---|---|---|---|---|---|---|---|---|
| Sensitive Material | Pixel Size | hwb | hwb − r | $\gamma_a/\gamma_d$ | $\gamma_x/\gamma_d$ | hwb | hwb − r | $\gamma_a/\gamma_d$ | $\gamma_x/\gamma_d$ | hwb | hwb − r | $\gamma_a/\gamma_d$ | $\gamma_x/\gamma_d$ | Remarks |
| 101 | 85 | 127 | 42 | 1.17 | 0.75 | 143 | 58 | 1.13 | 0.77 | 122 | 37 | 1.17 | 0.91 | Comp. |
| | 101 | 146 | 45 | 1.17 | 0.75 | 159 | 58 | 1.13 | 0.77 | 139 | 38 | 1.17 | 0.91 | |
| | 113 | 150 | 37 | 1.17 | 0.75 | 168 | 55 | 1.13 | 0.77 | 146 | 33 | 1.17 | 0.91 | |
| 501 | 85 | 122 | 37 | 1.02 | 0.98 | 127 | 42 | 1.04 | 0.96 | 123 | 38 | 1.04 | 0.96 | Inv. |
| | 101 | 136 | 35 | 1.02 | 0.98 | 144 | 43 | 1.04 | 0.96 | 138 | 37 | 1.04 | 0.96 | |
| | 113 | 154 | 41 | 1.02 | 0.98 | 159 | 46 | 1.04 | 0.96 | 154 | 41 | 1.04 | 0.96 | |
| 502 | 85 | 120 | 35 | 1.08 | 0.94 | 124 | 39 | 1.09 | 0.94 | 121 | 36 | 1.05 | 0.94 | Inv. |
| | 101 | 133 | 32 | 1.08 | 0.94 | 140 | 39 | 1.09 | 0.94 | 135 | 34 | 1.05 | 0.94 | |
| | 113 | 151 | 38 | 1.08 | 0.94 | 152 | 39 | 1.09 | 0.94 | 152 | 39 | 1.05 | 0.94 | |

(Image Quality Evaluation)

A picture including a text of 2-point and 4-point character each drawn by three levels of black, (B,G,R)=(0, 0, 0), (13, 13, 13) and (26, 26, 26), and a solid image of 50% gray was output by the scanning exposing apparatus to the light-sensitive materials. On the other hand, a negative image of the same picture was recorded on a color negative film, Konica color Centuria 100 using a digital film recorder LFR Mark 2, manufactured by Lasergraphic Co., Ltd. Then the film was processed to prepare the negative image. The picture was printed to the light-sensitive material through the negative image by an analogue exposure.

Thus prepared printed image are evaluated by 20 observers. The evaluation was performed regarding the reproducibility of character (a blackness of the image, sharpness of edge, color discrepancy at the outline of the character and eroding at the fine white portion), and the uniformity of the solid image (formation of the scanning noise line and roughness feeling of image) . Evaluation result is expressed by evaluation points (the maximum point was 100). A higher average value of the evaluation points marked by the 20 observers represents a enhanced effects of the invention that the print was excellent in the reproducibility of black character image and inhibited in the ununiformity of the scanning, and a beautiful print could be obtained when the image was printed according to the digital information and when the image was printed through the negative film in which the image information was recorded. The results are shown in Table 15.

TABLE 15

| Photosensitive Material | Image quality | Remarks |
|---|---|---|
| 101 | 56 | Comparative |
| 501 | 92 | Invention |
| 502 | 80 | Invention |

As is shown in Table 15, the image formed on Light-sensitive material 101 by the digital exposure, the evaluated point stays at a low level since the colored blur is shown at the edge of the black character and the character is somewhat expanded and inferior in the reproducibility of the fine structure of the character even though the image printed through a negative film, was pretty beautiful. The prints obtained by light-sensitive materials 501 and 502 each get a high evaluation point since the edge of the black character is sharp, and the scanning noise line and the ununiformity in the solid image area of 50% gray are almost not observed. Moreover the beautiful prints can be obtained in the either case of that the exposure is performed according to the digital information or that the exposure is performed through the negative film. It is understood that these light-sensitive materials are preferable.

Example 6

Light-sensitive materials 501 and 502 prepared in Example 5 and Light-sensitive material 101 prepared in Example 1 were subjected to the following evaluation.

An image including a text of 2-point and 4-point character each written by three levels of black, (B,G,R)=(0, 0, 0), (13, 13, 13) and (26, 26, 26), and a solid image of 50% gray was output by the scanning exposing apparatus to the light-sensitive materials. Moreover, the same image was output by QD-21, manufactured by Konica Corp., Nice Print System Ecojet NPS878JW Digital Plus Printer, manufactured by Konica Corp., or LVT Printer, manufactured by Kodak Co., Ltd., according the same image data.

Thus printed images were evaluated by 20 observers. The evaluation was performed regarding the reproducibility of character (a blackness of the image, sharpness of edge, color discrepancy at the outline of the character and eroding the fine white portion), and the uniformity of the solid image (formation of the scanning noise line and roughness feeling of image). Evaluation result was expressed by points (the maximum point was 100). A higher average value of the points marked by the 20 observers represents a enhanced effects of the invention that the print was excellent in the reproducibility of black character image and inhibited in the ununiformity of the scanning, and a beautiful print could be obtained independently on the kind of the digital exposing apparatus. The results of the evaluation are shown in Table 16.

TABLE 16

| Photosensitive Material | Image quality | Remarks |
|---|---|---|
| 101 | 56 | Comparative |
| 501 | 92 | Invention |
| 502 | 80 | Invention |

As is shown in Table 16, the image formed on Light-sensitive material 101 by the digital exposure, the evaluated point stays at a low level since the colored blur is shown at the edge of the black character and the character is somewhat expanded and inferior in the reproducibility of the fine structure of the character even though the scanning noise line and the ununiformity in the solid image area of 50% gray are almost not observed. The prints obtained by light-sensitive materials 501 and 502 each get a high evaluation point since the edge of the black character is sharp, and the scanning noise line and the ununiformity in the solid image area of 50% gray are almost not observed. Light sensitive materials 501 and 502 can be obtained by any kind of digital exposing apparatus. It is understood that Light-sensitive materials 501 and 502 are preferable.

What is claimed is:

1. An image forming method comprising steps of:

exposing a silver halide color photographic light-sensitive material comprising a support having thereon a yellow image-forming layer, a magenta image-forming layer and a cyan image-forming layer each containing light-sensitive silver halide by a scanning exposure, of which a pixel size is r, with a light beam in a scanning time of not more than $10^{-3}$ seconds per pixel; and developing the silver halide color photographic light-sensitive material, wherein when an image data of a black line having a width of r is reproduced onto the silver halide color photographic light-sensitive material by the exposing step, (hwb−r) of each of the yellow image-forming layer, the magenta image-forming layer and the cyan image-forming layer is within the range of from 0 to 50, in which hwb represents a half band width value in $\mu$m of a line reproduced on the exposed and developed silver halide color photographic light-sensitive material based on the image data of the black line, and wherein when an image data of a white line having a width of r is reproduced onto the silver halide color photographic light-sensitive material by the exposing step, (hww-r) of each of the yellow image-forming layer, the magenta image-forming layer and the cyan image-forming layer is within the range of from 15 to 65, in which hww is a half band width value in $\mu$m of a line reproduced on the exposed and developed silver halide color photographic light-sensitive material based on the image data of the white line.

2. The image forming method of claim 1, wherein (hww−r) of the yellow image-forming layer is the largest.

3. The image forming method of claim 1, wherein the ratio of the largest hww ($hww_{max}$) to the smallest hww ($hww_{min}$), $hww_{max}/hww_{min}$, of the yellow image-forming layer, the magenta image-forming layer and the cyan image-forming layer is within the range of from 1.0 to 1.1.

4. The image forming method of claim 1, wherein the ratio of hww to fww, hww/fww, of each of the yellow image-forming layer, the magenta image-forming layer and the cyan image-forming layer is within the range of from 0.3 to 0.4, in which fww is a width value at the legs in $\mu$m of a line reproduced on the exposed and developed silver halide color photographic light-sensitive material based on the image data of the white line. image-forming layer is the largest.

* * * * *

UNITED STATES PATENT AND TRADEMARK OFFICE

CERTIFICATE OF CORRECTION

PATENT NO. : 6,503,695 B1
DATED : January 7, 2003
INVENTOR(S) : Kazuhiro Miyazawa et al.

It is certified that error appears in the above-identified patent and that said Letters Patent is hereby corrected as shown below:

Title page,
Item [57], ABSTRACT,
Line 7, "form" should read -- from --.

Column 42,
Lines 45-46, after "line." delete "image-forming layer is the largest."

Signed and Sealed this

Twenty-fourth Day of February, 2004

JON W. DUDAS
*Acting Director of the United States Patent and Trademark Office*